US008502742B2

(12) United States Patent
Wakui et al.

(10) Patent No.: US 8,502,742 B2
(45) Date of Patent: Aug. 6, 2013

(54) ANTENNA APPARATUS

(75) Inventors: Masashi Wakui, Warabi (JP); Akio Kamiya, Warabi (JP); Nobuo Arayama, Warabi (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 13/603,775

(22) Filed: Sep. 5, 2012

(65) Prior Publication Data

US 2012/0326934 A1 Dec. 27, 2012

Related U.S. Application Data

(63) Continuation of application No. 12/735,199, filed as application No. PCT/JP2009/001231 on Mar. 19, 2009.

(30) Foreign Application Priority Data

Jul. 11, 2008 (JP) ..... 2008-181545

(51) Int. Cl.
*H01Q 1/1271* (2006.01)

(52) U.S. Cl.
USPC ..... 343/713; 343/711; 343/712

(58) Field of Classification Search
USPC ..... 343/725, 711, 712, 713, 872
See application file for complete search history.

(56) References Cited

U.S. PATENT DOCUMENTS

| | | | | |
|---|---|---|---|---|
| 2002/0171593 | A1 | 11/2002 | Wakui et al. | |
| 2007/0171138 | A1 * | 7/2007 | Noro | 343/713 |
| 2008/0117111 | A1 * | 5/2008 | Ikeda et al. | 343/713 |
| 2008/0198077 | A1 * | 8/2008 | Duzdar et al. | 343/715 |

FOREIGN PATENT DOCUMENTS

| | | |
|---|---|---|
| EP | 0 989 629 A1 | 3/2000 |
| JP | A-2000-77923 | 3/2000 |
| JP | A-2003-188619 | 7/2003 |
| JP | A-2003-229715 | 8/2003 |
| JP | A-2004-15096 | 1/2004 |
| JP | A-2005-72926 | 3/2005 |
| JP | A-2005-223957 | 8/2005 |

OTHER PUBLICATIONS

Sep. 26, 2012 Office Action issued in U.S. Appl. No. 12/735,199.

* cited by examiner

*Primary Examiner* — Douglas W Owens
*Assistant Examiner* — Collin Dawkins
(74) *Attorney, Agent, or Firm* — Oliff & Berridge, PLC

(57) ABSTRACT

An antenna apparatus that can suppress sensitivity degradation as much as possible to receive AM broadcasts and FM broadcasts even if an antenna height is decreased to 70 mm or less. An antenna board is vertically mounted on a planar antenna base, and a top portion is disposed to stride over the antenna board. An antenna element includes the top portion and an antenna pattern formed on the antenna board. A distance between the antenna base and a lower edge of the top portion is not less than 10 mm, and the lower edge of the top portion is bent downward. The top portion is configured such that an antenna capacitance of the antenna element becomes about 3 pF or more. A received signal from the antenna element is guided to an amplifier board through a connecting wire and amplified. An antenna case is fitted in the antenna base.

5 Claims, 31 Drawing Sheets

Vo: antenna element induction voltage
Vi : amplifier input voltage
Ca: antenna total capacitance
Ci : invalid capacitance (amplifier input capacitance) (ground capacitance)

ANTENNA APPARATUS

This is a Continuation of application Ser. No. 12/735,199 filed Jun. 21, 2010, which claims the benefit of Japanese Application No. 2008-181545 filed Jul. 11, 2008 and International Application No. PCT/JP2009/001231 filed Mar. 19, 2009. The disclosure of the prior applications is hereby incorporated by reference herein in its entirety.

TECHNICAL FIELD

The present invention relates to low-profile antenna apparatuses mounted in vehicles that can receive AM broadcasts and FM broadcasts.

BACKGROUND ART

Generally, prior antenna apparatuses mounted in vehicles can receive AM broadcasts and FM broadcasts. In the prior antenna apparatuses, rod antennas having a length of about 1 m have been used to receive the AM broadcasts and the FM broadcasts. The lengths of the rod antennas become almost quarter-wave in the FM wavebands while becoming extremely short with respect to the wavelengths in the AM wavebands, thereby extremely reducing the sensitivity of the rod antennas in the AM wavebands. Therefore, conventionally, the sensitivity has been secured in the AM wavebands so as to enhance the impedance of the rod antennas using high-impedance cables, or so as to amplify signals with AM-waveband amplifiers. There have been also used in-car helical antenna apparatuses in which rod portions of the antennas are wound in helical shapes to shorten the antenna lengths to about 186 mm to about 400 mm. However, the amplifiers are provided immediately below the antennas in order to compensate performance degradation caused by the shortened rod portions.

FIG. 70 is a side view illustrating a configuration of a prior antenna apparatus 100 in which a rod portion is shortened. The prior antenna apparatus 100 of FIG. 70 includes an element 110 and an antenna basis 111 in which a lower end of the element 110 is rotatably mounted within a predetermined angle range. The antenna basis 111 includes an antenna cover and an antenna base. An amplifier and a matching circuit are incorporated in the antenna cover, and the antenna base is fitted in a lower surface of the antenna cover. A bolt portion is projected from the lower surface of the antenna base in order to mount the antenna apparatus 100 in a vehicle body. The antenna apparatus 100 receives AM broadcasts and FM broadcasts, the element 110 has a length of about 180 mm, and a total height h100 from the lower surface of the antenna basis 111 to a leading end of the element 110 is set at about 195 mm. The element 110 includes a helical element and an element cover with which the helical element is covered.

FIG. 71 is a side view illustrating the state in which, in the antenna apparatus 100, the element 110 is rotated in a direction perpendicular to the antenna basis 111 to set a height h101 from the lower surface of the antenna basis 111 to the leading end of the element 110 at about 70 mm.

PATENT DOCUMENT 1

Japanese Publication Unexamined Patent Application No. 2005-223957

PATENT DOCUMENT 2

Japanese Publication Unexamined Patent Application No. 2003-188619

DISCLOSURE OF THE INVENTION

Problem that the Invention is Intended to Solve

When such a prior antenna apparatus 100 is mounted in a vehicle body, the appearance and design of a vehicle are spoiled because an element 110 is largely projected from the vehicle body. Further, unfortunately antenna performance is lost when a user forgets to raise a rod portion brought down in putting the vehicle in a garage or washing the vehicle. Because the antenna apparatus 100 is exposed to the outside of the vehicle, there is a risk of stealing the element 110. Therefore, there has been proposed an in-car antenna apparatus in which the antenna is accommodated in the antenna case. At this point, the height of the antenna apparatus projected from the vehicle is restricted to 70 mm or less under the regulation of vehicle external protrusion, and a longitudinal length is suitable ranges from about 160-220 mm such that the appearance of the vehicle is not spoiled. Because a radiation resistance Rrad of the antenna is expressed by 600 to 800× $(\text{height}/\text{wavelength})^2$, the radiation resistance Rrad is substantially in proportion to the square of antenna height. For example, in the antenna apparatus 100, when the element 110 is rotated to decrease the element height from about 195 mm illustrated in FIG. 70 to about 70 mm illustrated in FIG. 71, the sensitivity is also degraded by about 7 dB. Thus, there was such a problem as to largely degrade the performance to make the practical use difficult when the height of the element 110 is simply decreased. In addition, there was such a problem as to decrease the radiation resistance Rrad by decreasing the antenna height to a low level of 70 mm or less, resulting in easy reduction in radiation efficiency by an influence of a conductor loss of the antenna and further degradation in the sensitivity.

In view of the foregoing, an object of the invention is to provide an antenna apparatus that can suppress sensitivity degradation as much as possible to receive AM broadcasts and FM broadcasts even if its antenna height is decreased to a low level of 70 mm or less.

Means for Solving the Problem

In order to achieve the above mentioned object, in accordance with an embodiment of the invention, an antenna apparatus that is projected with a height of 70 mm or less when mounted in a vehicle body, includes an antenna case and an antenna portion that is accommodated in the antenna case, wherein an antenna board is vertically provided on an antenna base fitted in a lower end of the antenna case, an antenna pattern is formed in an upper portion of the antenna board, a top portion whose section is formed into a chevron shape is disposed so as to stride over the antenna board, a distance between the antenna base and a lower edge of a side portion constituting an inclined plane of the top portion is not lower than about 10 mm, a size of the top portion is configured such that an antenna capacitance of an antenna element becomes about 3 pF or more, and the antenna element includes the top portion and an antenna pattern.

Effect of the Invention

In the antenna apparatus according to an embodiment of the invention, because the section of the top portion is formed into the chevron shape, a facing area between the antenna base and the side portion constituting the inclined plane of the top portion can be reduced as much as possible, and an invalid capacitance of the antenna capacitance can be reduced as much as possible. Further, the distance between the antenna base and the lower edge of the side portion constituting the inclined plane of the top portion is not lower than about 10 mm, and the antenna capacitance of the antenna element including the top portion and the antenna pattern is not lower than about 3 pF. Therefore, when the antenna apparatus mounted in the vehicle body is projected with the height of 70 mm or less, the antenna apparatus can obtain the antenna performance substantially comparable to that of a prior antenna apparatus having a height of about 195 mm.

EXPLANATION OF THE REFERENCE SYMBOLS

Figure 1:
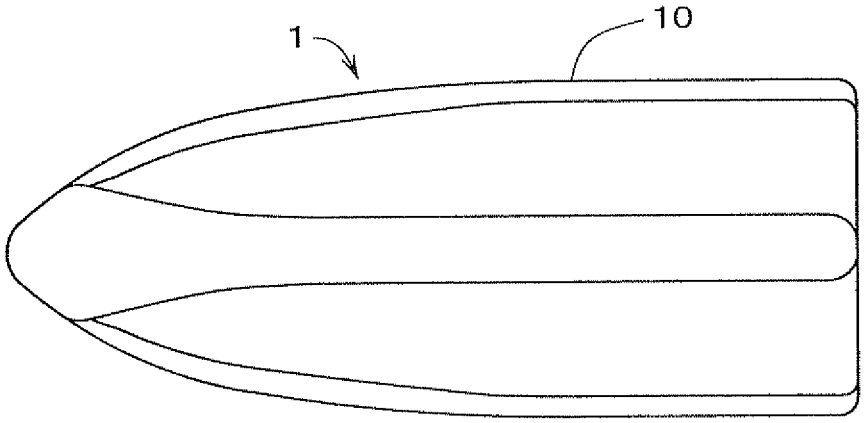
FIG. 1 is a plan view illustrating a configuration of an antenna apparatus according to an embodiment of the invention.

1 antenna apparatus
10 antenna case
20 antenna base
20*a* body portion
20*b* antenna mounting portion
20*c* screw hole
20*d* screw portion
20*e* boss
20*f* fitting hole
20*g* rectangular hole
20*h* cable lead hole
20*i* rectangular hole
21 bolt portion
22 cable
24 base pad
24*a* body portion
24*b* circumferential wall portion
24*c* notch hole
24*d* hole portion
30 antenna board
30*a* board body
30*b* antenna pattern
30*c* pattern
30*d* mounting hole
30*e* long hole
30*f* projection portion
30*g* hole portion
30*h* protrusion
30*i* notch
31 top portion
31*a* first side portion
31*b* second side portion
31*c* contact piece
31*d* screw hole
31*e* flat portion
31*f* slit
32 GPS antenna
33 connecting wire
33*a* body portion
33*b* U-shape portion
33*c* U-shape portion
33*d* bent portion
34 amplifier board
34*a* board body
34*b* screw hole
34*b* insertion hole
35 coil
35*a* coil body
35*b* lead wire
36 connecting hardware
36*a* clipping body
36*b* contact piece
36*c* clipping piece
40 screw
41 screw
42 screw
43 terminal
44 hook
44*a* body portion
44*b* fitting leg portion
44*c* engagement leg portion
45 collar
46 screw
47 nut
50 antenna element portion
51 amplifier circuit portion
100 antenna apparatus
110 element
111 antenna basis

BEST MODE FOR CARRYING OUT THE INVENTION

Figure 2:
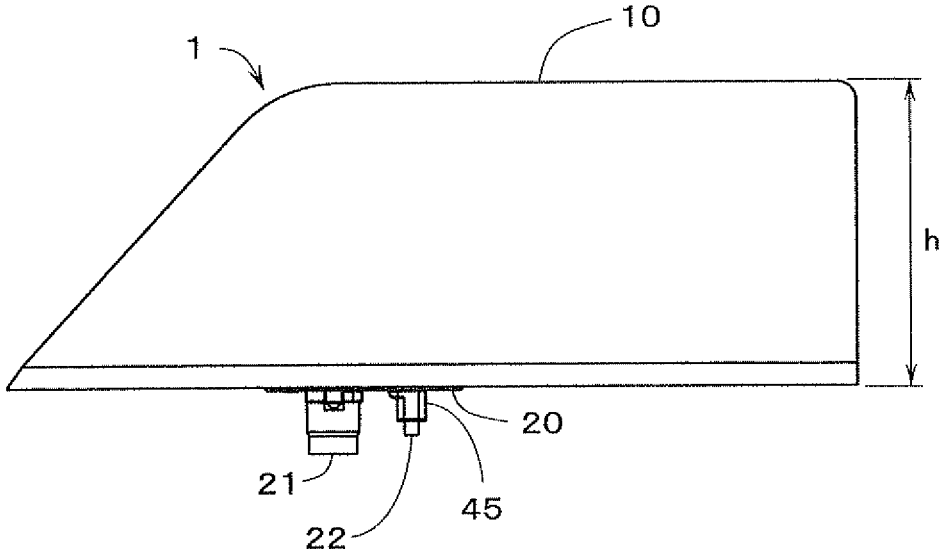
FIG. 2 is a front view illustrating the configuration of the antenna apparatus according to an embodiment of the invention.
Figure 3:
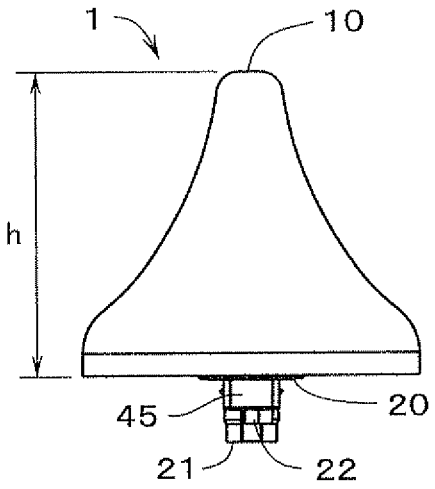
FIG. 3 is a side view illustrating the configuration of the antenna apparatus according to an embodiment of the invention.
Figure 4:
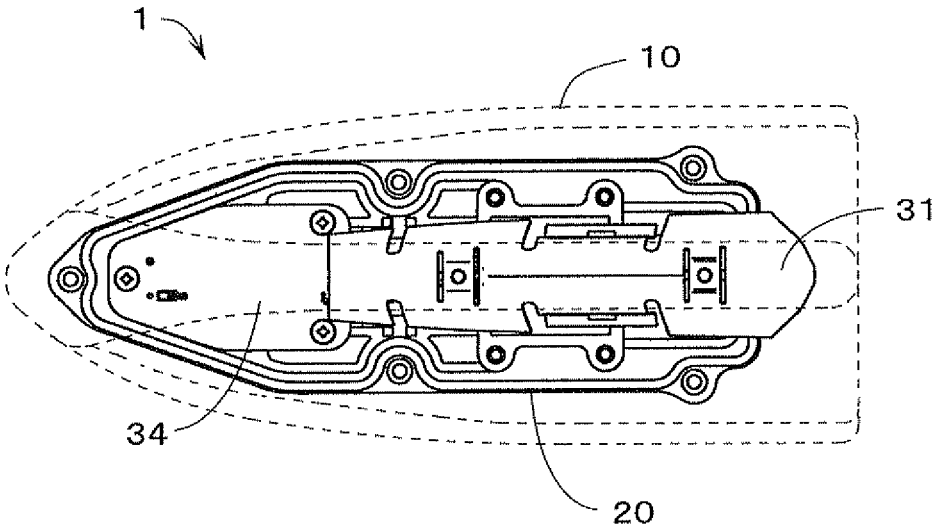
FIG. 4 is a plan view illustrating an internal configuration of the antenna apparatus according to an embodiment of the invention.
Figure 5:
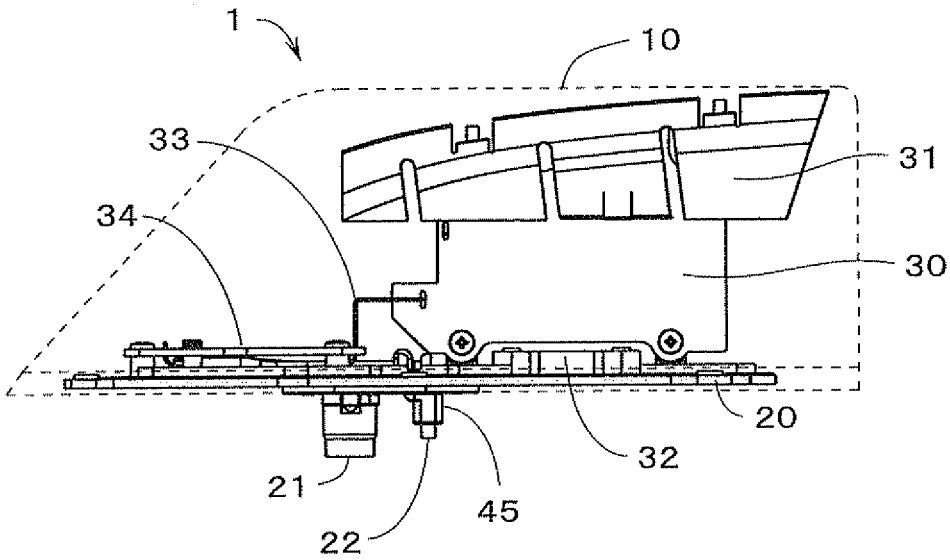
FIG. 5 is a front view illustrating the internal configuration of the antenna apparatus according to an embodiment of the invention.
Figure 6:
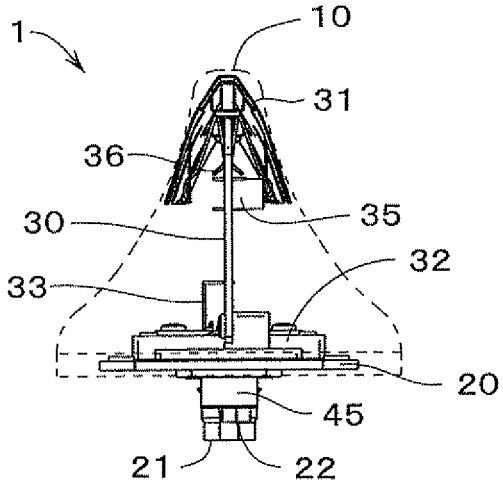
FIG. 6 is a right side view illustrating the internal configuration of the antenna apparatus according to an embodiment of the invention.

FIGS. 1 to 6 illustrate a configuration of antenna apparatus according to an embodiment of the invention. FIG. 1 is a plan view illustrating a configuration of an antenna apparatus 1 according to an embodiment of the invention, FIG. 2 is a front view illustrating the configuration of the antenna apparatus 1 according to an embodiment of the invention, FIG. 3 is a side view illustrating the configuration of the antenna apparatus 1 according to an embodiment of the invention, FIG. 4 is a plan view illustrating an internal configuration of the antenna apparatus 1 according to an embodiment of the invention, FIG. 5 is a front view illustrating the internal configuration of the antenna apparatus 1 according to an embodiment of the invention, and FIG. 6 is a right side view illustrating the internal configuration of the antenna apparatus 1 according to an embodiment of the invention. The antenna apparatus 1 according to an embodiment of the invention of FIGS. 1 to 6 is mounted on a roof of the vehicle, and a height h of the antenna apparatus 1 projected from the vehicle is set at about 70 mm when the antenna apparatus 1 is mounted on the vehicle. Although the antenna apparatus 1 has an extremely low profile (assuming that $\lambda$ is a wavelength at a frequency of 100 MHz, the height h is about $0.0023\lambda$ or less), the antenna apparatus 1 can receive AM broadcasts and FM broadcasts. The antenna apparatus 1 has a streamline shape in which the antenna apparatus 1 is thinned toward a leading end thereof, and the shape of the antenna apparatus can freely be determined within a certain level of range such that the appearance and design of the vehicle are not spoiled. A soft base pad made of rubber or elastomer is fitted in a lower surface of the antenna apparatus 1 such that the antenna apparatus 1 can be mounted in the vehicle in a watertight manner.

The antenna apparatus 1 according to an embodiment of the invention includes a resin antenna case 10, a metal antenna base 20 in which a lower portion of the antenna case 10 is fitted, an antenna board 30 that is mounted perpendicular to the antenna base 20 and an amplifier board 34 that is mounted in parallel to the antenna base 20, a top portion 31, and a GPS antenna 32 that is mounted on the antenna base 20. The top portion 31 whose section is formed into a chevron shape is disposed so as to stride over the antenna board 30, and the top portion 31 includes an apex portion and side portions that are formed as inclined planes from both sides of the apex portion. The antenna case 10 is made of synthetic resin having a radiowave-transmitting property, and the antenna case 10 has a streamline shape in which the antenna case 10 is thinned toward the leading end thereof. A space where the vertically-provided antenna board 30 and the top portion 31 disposed in an upper portion of the antenna board 30 can be accommodated and a space where the amplifier board 34 can horizontally be accommodated are formed in the antenna case 10. The metal antenna base 20 is fitted in a lower surface of the antenna case 10. The antenna board 30 is fixed to the antenna base 20 while vertically provided, and the amplifier board 34 is fixed in front of the antenna board 30 while provided in parallel with the antenna base 20. An antenna pattern is formed in the upper portion of the antenna board 30. The top portion 31 is incorporated in the upper portion of the antenna case 10. When the antenna case 10 is fitted in the antenna base 20, the top portion 31 incorporated in the antenna case 10 is disposed so as to stride over the upper portion of the antenna board 30, thereby bringing connecting hardware 36 mounted in the upper portion of the antenna board 30 into electrical contact with an inner surface of the top portion 31. Because the connecting hardware 36 is brought into electrical contact with the antenna pattern formed in the antenna board 30, the top portion 31 and the antenna pattern are connected through the connecting hardware 36. Therefore, the antenna pattern and the top portion 31 constitute an antenna element, and the antenna board 30, the top portion 31, and the amplifier board 34 are accommodated in the space of the antenna case 10.

A coil 35 is provided on the antenna board 30 in order to resonate the antenna element near the FM waveband. The antenna element includes the antenna pattern and the top portion 31. A first end of the coil 35 is connected to the antenna pattern, a second end of the coil 35 is connected to a first end of a pattern formed on the antenna board 30, and a first end of the connecting wire 33 is connected to a second end of the pattern. A second end of the connecting wire 33 is connected to an input portion of an AM/FM amplifier provided in the amplifier board 34, and an AM/FM received signal, which is received by the antenna element including the antenna pattern and the top portion 31, is fed into and amplified by the AM/FM amplifier. A bolt portion 21 is projected from the lower surface of the antenna base 20 in order to mount the antenna apparatus 1 on the vehicle. A cable 22 that guides the received signal into the vehicle from the antenna apparatus 1 is led out from the lower surface of the antenna base 20. The cable 22 is led out from the amplifier board 34. The cable 22 includes a cable that guides the AM received signal and FM received signal, which are amplified by the AM/FM amplifier provided in the amplifier board 34, and a collar 45 bundles the cables 22. At this point, holes into which the bolt portion 21 and the cables 22 are inserted are made in the roof of the vehicle, and the antenna apparatus 1 is placed on the roof such that the bolt portion 21 and the cables 22 are inserted into the holes. The antenna apparatus 1 is fixed to the roof of the vehicle by engaging a nut on the bolt portion 21 projected toward the inside of the vehicle. An electric power is supplied from the inside of the vehicle through the cables 22 to the amplifier board 34 accommodated in the antenna case 10.

Figure 7:
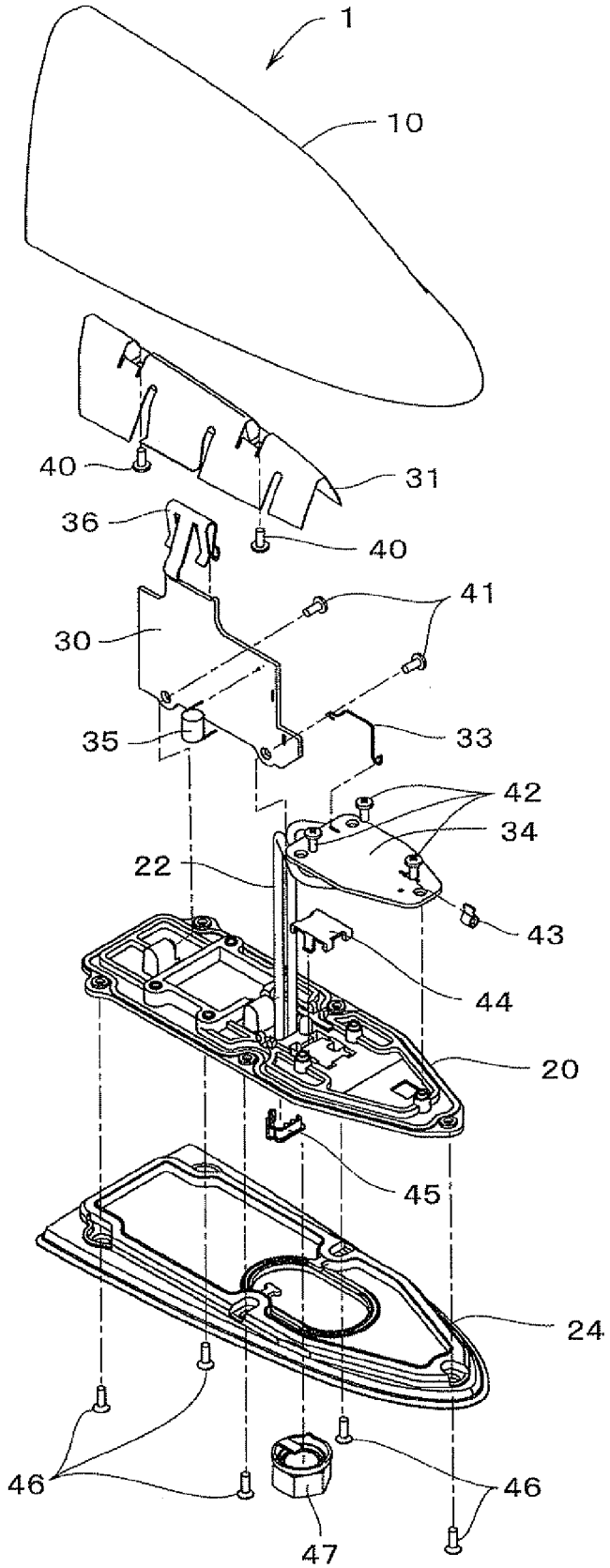
FIG. 7 is an exploded view of the antenna apparatus according to an embodiment of the invention.

FIG. 7 is an exploded view of the antenna apparatus 1 according to an embodiment of the invention. Assembling of the antenna apparatus 1 according to an embodiment of the invention will be described with reference to FIG. 7. The top portion 31 is fixed to the upper portion of the antenna case 10 by two screws 40. The connecting hardware 36 is fitted in an upper end of the antenna board 30. The connecting hardware 36 is mounted in the upper portion of the antenna board 30 by clipping the antenna board 30. The coil 35 is mounted on the antenna board 30 by soldering. The antenna board 30 is fixed to the antenna base 20 by two screws 41 while vertically provided. The amplifier board 34 is disposed in front of the antenna board 30, and the amplifier board 34 is fixed to the antenna base 20 substantially in parallel to the antenna base 20 by three screws 42. The cable 22 through which the amplified AM received signal and FM received signal are tapped off is led out from the amplifier board 34, a terminal 43 is attached to the leading end of the cable 22, and the terminal 43 is fixed to a rear surface of the amplifier board 34. A first end of the connecting wire 33 is connected to the antenna board 30, and a second end of the connecting wire 33 is connected to the amplifier board 34. Therefore, an output end of the coil 35 provided in the antenna board 30 and an input end of the AM/FM amplifier provided in the amplifier board 34 are connected to each other, and the AM/FM received signal received by the antenna element including the antenna pattern and the top portion 31 is fed into the AM/FM amplifier on the amplifier board 34. The collar 45 is fitted in roots of the cables 22 so as to bundle the cables 22 led out from the lead hole of the antenna base 20.

A hook 44 is disposed below the amplifier board 34, and the hook 44 is fitted in the antenna base 20. A pair of long engagement leg portions is stretched from both side faces of the hook 44. When the antenna apparatus 1 is mounted on the vehicle, the engagement leg portion is engaged with an edge of a mounting hole made in the vehicle, thereby tentatively joining the antenna apparatus 1 to the vehicle body. Therefore, when a nut 47 is engaged with the bolt portion 21 from the inside of the vehicle without retaining the antenna apparatus 1 from the outside of the vehicle body, the antenna apparatus 1 can be screwed without dropping out from the mounting hole. The base pad 24 is fitted in the lower surface of the antenna base 20. A hole portion into which heads of the five screws can be inserted is made in a peripheral portion of the base pad 24. Five screws 46 are inserted into the hole portion from below, the screws 46 are inserted into a fitting hole made in a peripheral portion of the antenna base 20, and the screws 46 are engaged with a periphery in the lower surface of the antenna case 10. Therefore, the antenna apparatus 1 can be assembled. As described above, the antenna apparatus 1 is tentatively joined to the mounting hole by the hook 44, when the assembled antenna apparatus 1 is amounted while the bolt portion 21 is aligned with a mounting hole made in the vehicle. At this point, a nut 47 is engaged with the bolt portion 21 from the inside of the vehicle, which allows the antenna apparatus 1 to be mounted on the vehicle body.

Figure 8:
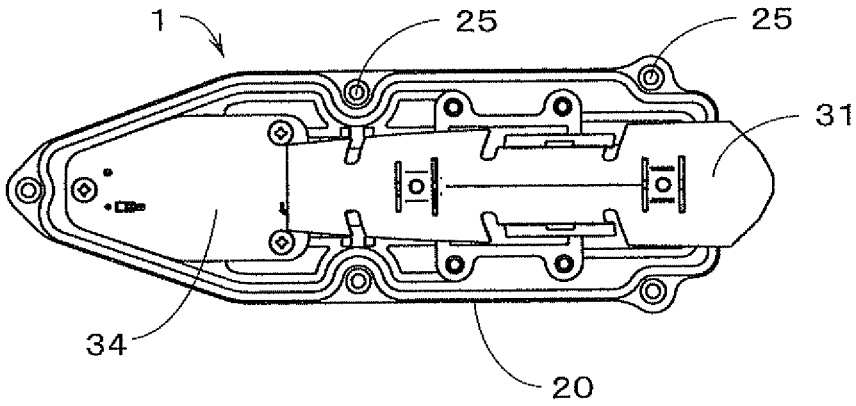
FIG. 8 is a plan view illustrating a configuration in which an antenna case and a base pad of the antenna apparatus according to an embodiment of the invention are neglected.
Figure 9:
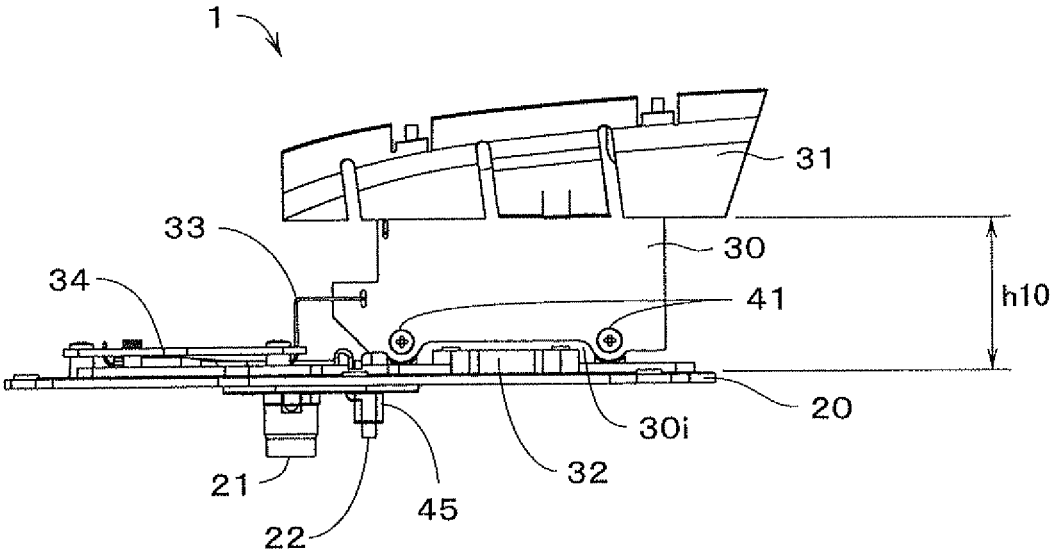
FIG. 9 is a front view illustrating the configuration in which the antenna case and the base pad of the antenna apparatus according to an embodiment of the invention are neglected.
Figure 10:
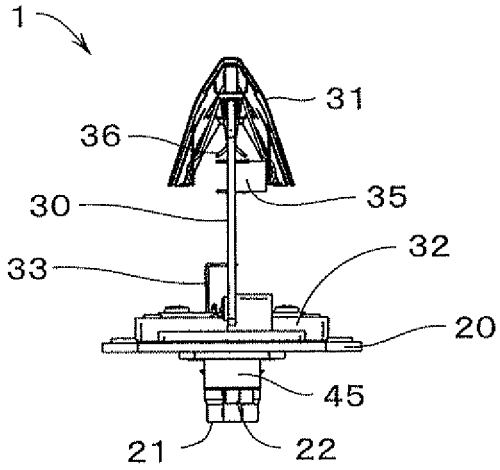
FIG. 10 is a right side view illustrating the configuration in which the antenna case and the base pad of the antenna apparatus according to an embodiment of the invention are neglected.
Figure 11:
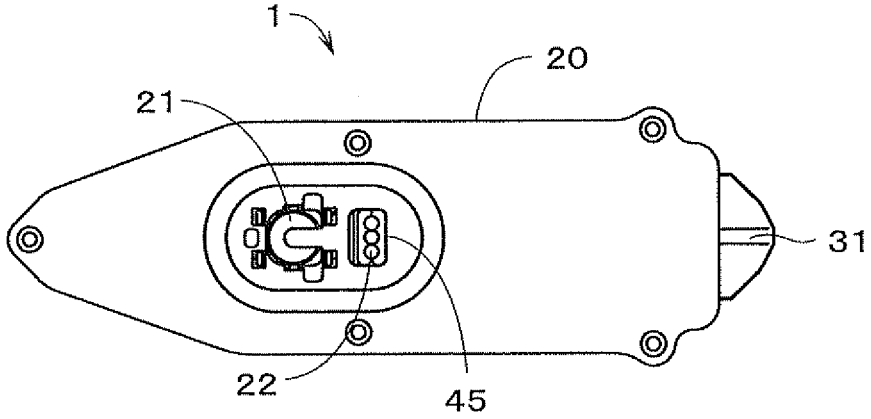
FIG. 11 is a bottom view illustrating the configuration in which the antenna case and the base pad of the antenna apparatus according to an embodiment of the invention are neglected.

FIGS. 8 to 11 illustrate the configuration of the antenna apparatus 1 assembled as illustrated in FIG. 7. FIG. 8 is a plan view illustrating the configuration of the antenna apparatus 1 according to an embodiment of the invention, FIG. 9 is a front view illustrating the configuration of the antenna apparatus 1 according to an embodiment of the invention, FIG. 10 is a right side view illustrating the configuration of the antenna apparatus 1 according to an embodiment of the invention, and FIG. 11 is a bottom view illustrating the configuration of the antenna apparatus 1 according to an embodiment of the invention. However, the antenna case 10 and the base pad 24 are neglected in FIGS. 8 to 11. Because the configurations of the antenna apparatus 1 of FIGS. 8 to 11 are described above, the description is omitted. The antenna board 30 is vertically mounted on the antenna base 20 by the two screws 41, a notch **30*i* is formed at a lower end of the antenna board 30, and a GPS antenna 32 can be mounted on the antenna base 20 so as to be partially accommodated in the notch 30*i*. When the GPS antenna 32 is mounted, the cable is also led out along the cable 22 from the GPS antenna 32 along the cable 22. For example, a distance h10 between a lower edge of the side portion and the upper surface of the antenna base 20 is set at about 34.4 mm. The side portion constitutes the inclined plane of the top portion 31 that is disposed so as to stride over the upper portion of the antenna board 30. The GPS antenna 32 is mounted as needed basis. A rear portion of the top portion 31 is obliquely cut, and the rear portion is projected rearward from the rear end of the antenna base 20, thereby reducing a contact area with the antenna base 20** as much as possible.

Figure 12:
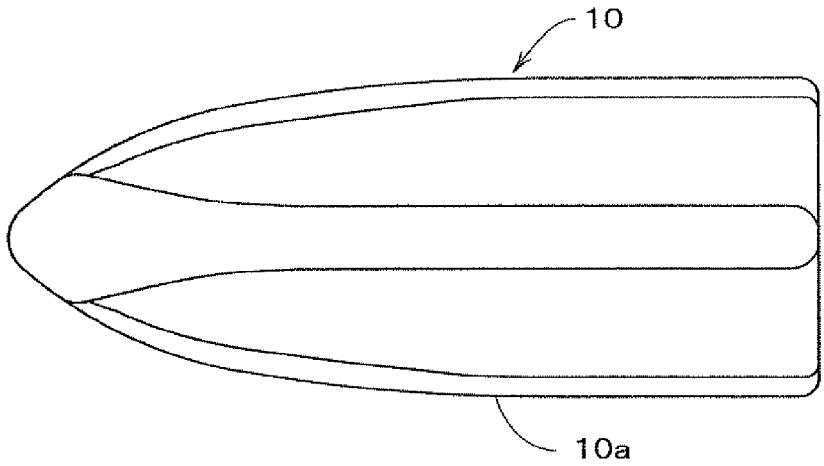
FIG. 12 is a plan view illustrating a configuration of an antenna case in the antenna apparatus according to an embodiment of the invention.
Figure 13:
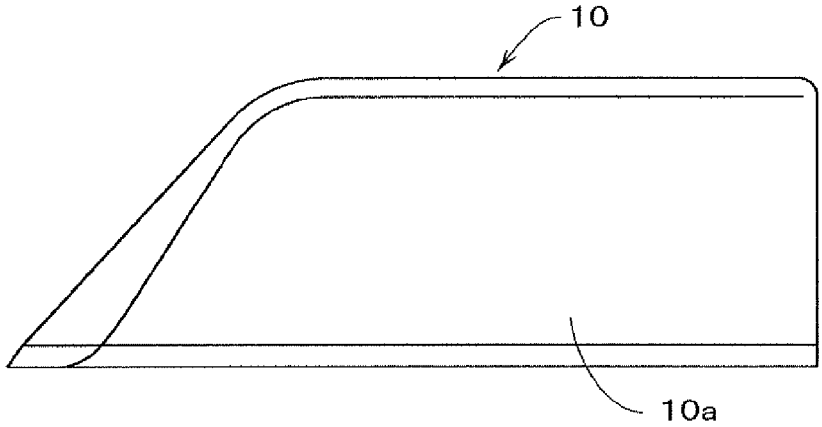
FIG. 13 is a front view illustrating the configuration of the antenna case in the antenna apparatus according to an embodiment of the invention.
Figure 14:
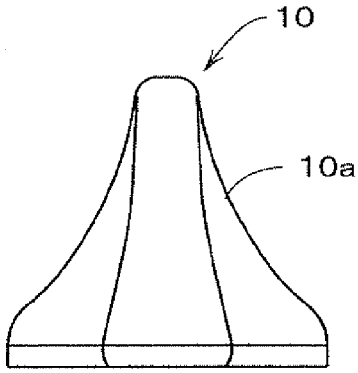
FIG. 14 is a left side view illustrating the configuration of the antenna case in the antenna apparatus according to an embodiment of the invention.

A configuration of each portion constituting the antenna apparatus 1 will be described below. FIGS. 12 to 14 illustrate a configuration of the antenna case 10. FIG. 12 is a plan view illustrating the configuration of the antenna case 10, FIG. 13 is a front view illustrating the configuration of the antenna case 10, and FIG. 14 is a left side view illustrating the configuration of the antenna case 10. As illustrated in FIGS. 12 to 14, the antenna case 10 is made of the synthetic resin having the radiowave-transmitting property, and the antenna case 10 has the streamline shape in which the antenna case 10 is thinned toward the leading end thereof. The space where the vertically-provided antenna board 30 and the top portion 31 disposed in the upper portion of the antenna board 30 can be accommodated and the space where the amplifier board 34 can horizontally be accommodated are formed in the antenna case 10.

Figure 15:
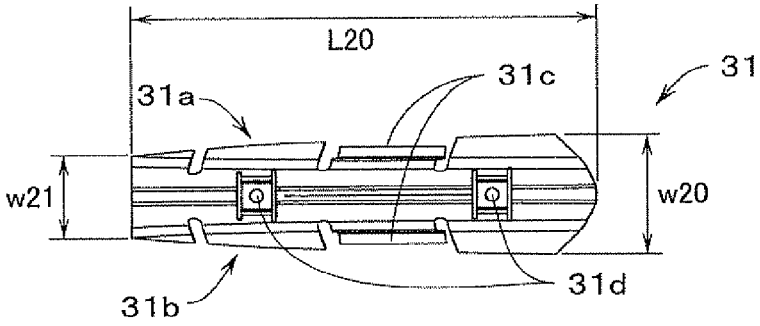
FIG. 15 is a plan view illustrating a configuration of a top portion in the antenna apparatus according to an embodiment of the invention.
Figure 16:
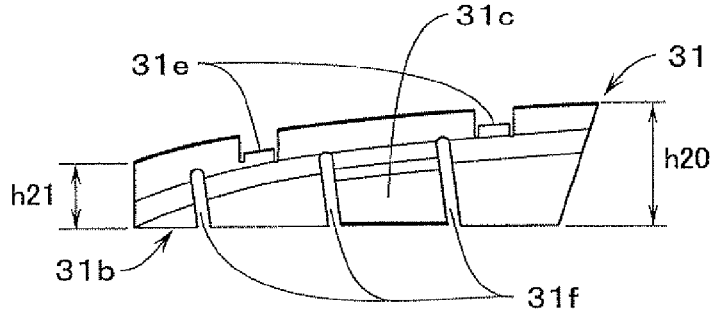
FIG. 16 is a front view illustrating the configuration of the top portion in the antenna apparatus according to an embodiment of the invention.
Figure 17:
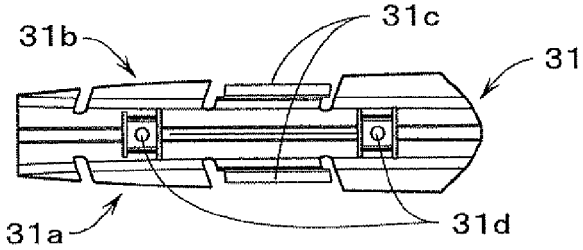
FIG. 17 is a bottom view illustrating the configuration of the top portion in the antenna apparatus according to an embodiment of the invention.
Figure 18:
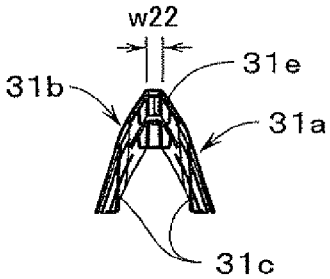
FIG. 18 is a right side view illustrating the configuration of the top portion in the antenna apparatus according to an embodiment of the invention.

FIGS. 15 to 18 illustrate a configuration of the top portion 31. FIG. 15 is a plan view illustrating the configuration of the top portion 31, FIG. 16 is a front view illustrating the configuration of the top portion 31, FIG. 17 is a bottom view illustrating the configuration of the top portion 31, and FIG. 18 is a right side view illustrating the configuration of the top portion 31. The top portion 31 of FIGS. 15 to 18 is formed by processing a metal plate. The top portion 31 includes the apex portion having a curved surface that gently descends frontward. In the top portion 31, a first side portion 31*a* and a second side portion 31*b* are formed while inclined to both sides from the apex portion. The first side portion 31*a* and the second side portion 31*b* have steeply inclined planes. Three slits 31*f* are formed in each of the first side portion 31*a* and the second side portion 31*b*, and each of the side portions 31*a* and 31*b* includes four pieces. In the pieces, a pair of pieces located in the substantial center constitutes contact pieces 31*c*. The contact piece 31*c* is substantially perpendicularly bent at a midpoint. Two flat portions 310 are formed in the apex portion of the top portion 31, and a screw hole 31*d* is made in each of the flat portions 31*e*. The screw 40 is inserted into the screw hole 31*d*, and the screw 40 is engaged with the inside of the apex portion of the antenna case 10, thereby incorporating the top portion 31 in the antenna case 10.

Assuming that L20 is a length of the top portion 31, w20 is a width of the rear end, w21 is a width of the front end, and h20 is a height, for example, the length L20 is set at about 106 mm, the width w20 of the rear end is set at about 28 mm, the width w21 of the front end is set at about 19 mm, the height h20 is set at about 28 mm. A narrow width w22 of the apex portion of the top portion 31 is set at about 4 mm. The reason the first side portion 31*a* and second side portion 31*b* of the top portion 31 have the steeply inclined planes is that the shape of the top portion 31 is matched with the sectional shape inside the antenna case 10, and mainly the reason the first side portion 31*a* and second side portion 31*b* have the steeply inclined planes is that the facing area between the top portion 31 and antenna base 20 is reduced to decrease a floating capacitance between the top portion 31 and the antenna base 20. The floating capacitance becomes an invalid capacitance in the antenna capacitance to reduce a gain of the antenna. The rear portion of the top portion 31 is obliquely cut to reduce the area facing the antenna base 20 as much as possible.

Figure 19A:
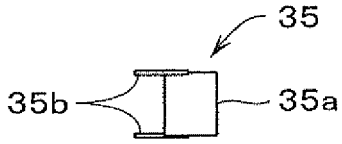
FIG. 19(*a*) is a front view illustrating a configuration of a coil in the antenna apparatus according to an embodiment of the invention and FIG. 19(*b*) is a side view illustrating a configuration of a coil in the antenna apparatus according to an embodiment of the invention.
Figure 19B:
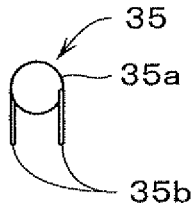

FIGS. 19(*a*) and (*b*) illustrate a configuration of the coil 35. The coil 35 is used to resonate the antenna element near the FM waveband. The antenna element having the small antenna capacitance includes the top portion 31 and the antenna pattern formed in the antenna board 30. FIG. 19(*a*) is a front view illustrating the configuration of the coil 35, and FIG. 19(*b*) is a side view illustrating the configuration of the coil 35. The coil 35 of FIGS. 19(*a*) and (*b*) includes a cylindrical coil body 35*a* around which the coil is wound and two lead wires 35*b* that are led out from the coil body 35*a*. The coil 35 is connected in series with the antenna element in order to resonate the antenna element near the FM waveband. As described above, the antenna element of the antenna apparatus 1 includes the top portion 31 and the antenna pattern formed in the antenna board 30. Because the antenna element has the antenna capacitance of about 4.7 pF, the antenna element can be resonated near the FM waveband by serially inserting the coil 35 ranging from about 0.5 μH to about 3 μH. Therefore, the antenna element including the top portion 31 and the antenna pattern is operated well in the FM waveband by the action of the coil 35. The antenna element resonated in the FM waveband is utilized as a voltage receiving element in the AM waveband, thereby receiving the AM waveband.

Figure 20A:
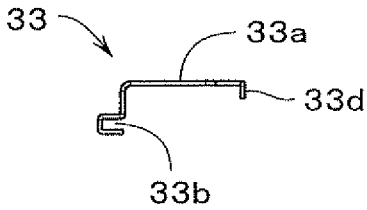
FIG. 20(*a*) is a plan view illustrating a configuration of a connecting wire in the antenna apparatus according to an embodiment of the invention, FIG. 20(*b*) is a front view illustrating a configuration of a connecting wire in the antenna apparatus according to an embodiment of the invention and FIG. 20(*c*) is a right side view illustrating a configuration of a connecting wire in the antenna apparatus according to an embodiment of the invention.
Figure 20B:
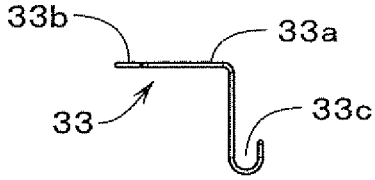
Figure 20C:
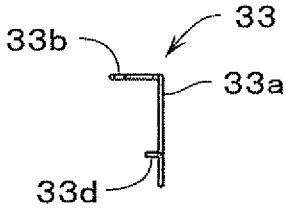

FIGS. 20(*a*), (*b*), and (*c*) illustrates a configuration of the connecting wire 33. FIG. 20(*a*) is a plan view illustrating the configuration of the connecting wire 33, FIG. 20(*b*) is a front view illustrating the configuration of the connecting wire 33, and FIG. 20(*c*) is a right side view illustrating the configuration of the connecting wire 33. The connecting wire 33 of FIGS. 20(*a*), (*b*), and (*c*) is used to guide the received signal tapped off from the antenna board 30 to the amplifier board 34, and the connecting wire 33 is formed by bending a wire-like conductor. The connecting wire 33 includes a body portion 33*a* that is bent into an L-shape when viewed from the front surface. An end portion in the upper portion of the connecting wire 33 constitutes a U-shape portion 33*b* that is bent into a U-shape, and the U-shape portion 33*b* is soldered while inserted into a long hole made in the antenna board 30. An end portion in the lower portion of the connecting wire 33 constitutes a U-shape portion 33*c* that is bent into a U-shape. The connecting wire 33 also includes a bent portion 33*d* at the leading end of the U-shape portion 33*c*, and the bent portion 33*d* is bent substantially in parallel to the body portion 33*a*. The bent portion 33*d* and the U-shape portion 33*c* are soldered while inserted into an insertion hole made in the amplifier board 34.

Figure 21:
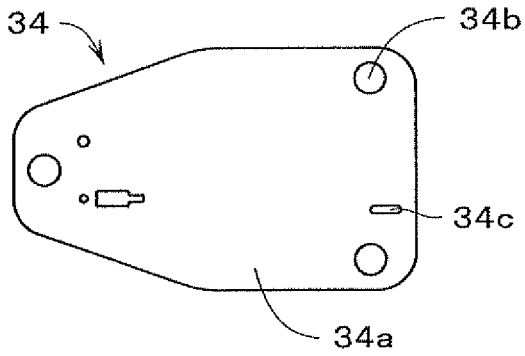
FIG. 21 is a plan view illustrating a configuration of an amplifier board in the antenna apparatus according to an embodiment of the invention.
Figure 22:
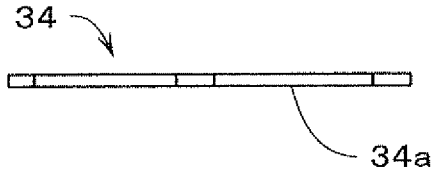
FIG. 22 is a front view illustrating the configuration of the amplifier board in the antenna apparatus according to an embodiment of the invention.
Figure 23A:
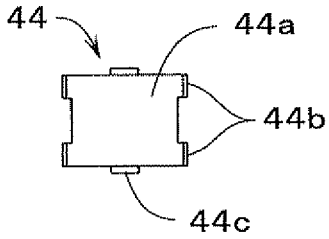
FIG. 23(*a*) is a plan view illustrating a configuration of a hook in the antenna apparatus according to an embodiment of the invention, FIG. 23(*b*) is a bottom view illustrating a configuration of a hook in the antenna apparatus according to an embodiment of the invention, FIG. 23(*c*) is a side view illustrating a configuration of a hook in the antenna apparatus according to an embodiment of the invention and FIG. 23(*d*) is a front view illustrating a configuration of a hook in the antenna apparatus according to an embodiment of the invention.
Figure 23B:
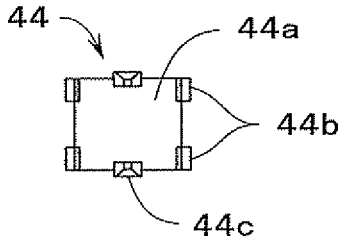
Figure 23C:
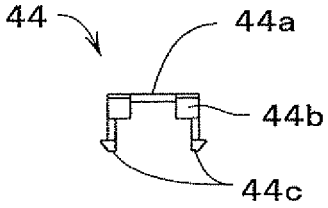
Figure 23D:
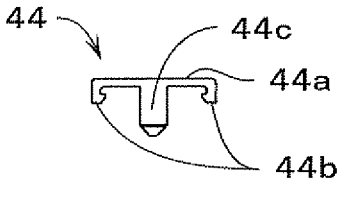

FIGS. 21 and 22 illustrate a configuration of the amplifier board 34. FIG. 21 is a plan view illustrating the configuration of the amplifier board 34, and FIG. 22 is a front view illustrating the configuration of the amplifier board 34. As illustrated in FIGS. 21 and 22, the amplifier board 34 includes a substantially rectangular board body 34*a* whose front portion is tapered. Three screw holes 34*b* are made in a peripheral portion of the board body 34*a*, and a long insertion hole 34*c* is made in the rear portion of the board body 34*a*. The bent portion 33*d* and the U-shape portion 33*c*, which are formed in the lower portion of the connecting wire 33, are soldered while inserted into the insertion holes 34*b*. The screws 42 are inserted into the three screw holes 34*b* and engaged with the bosses 20*e* of the antenna base 20, thereby fixing the amplifier board 34 to the antenna base 20.

FIGS. 23(*a*) to (*d*) illustrate a configuration of the hook 44. FIG. 23(*a*) is a plan view illustrating the configuration of the hook 44, FIG. 23(*b*) is a bottom view illustrating the configuration of the hook 44, FIG. 23(*c*) is a side view illustrating the configuration of the hook 44, and FIG. 23(*d*) is a front view illustrating the configuration of the hook 44. The hook 44 of FIGS. 23(*a*) to (*d*) includes a rectangular body portion 44*a*. Fitting leg portions 44*b* are formed downward in the hook 44 from four corners of the body portion 44*a*, respectively. The Fitting leg portions 44*b* are formed in both side portions on one side so as to face each other, and a hook-shape engagement piece is formed at the leading end of the fitting leg portion 44*b*. A long engagement leg portion 44*c* is formed in a side portion on the other side so as to be stretched downward from the substantial center in the side portion, and the long engagement leg portions 44*c* face each other. When the hook 44 is mounted on the antenna base 20, the fitting leg portion

44*b* is engaged with the edge portion of the rectangular hole made in antenna base 20, the long engagement leg portion 44*c* pierces through the rectangular hole made in the antenna base 20, and the engagement leg portion 44*c* is projected along the side face of the bolt portion 21. When the antenna apparatus 1 is mounted on the vehicle body, the engagement leg portion 44*c* is engaged with the edge portion of the mounting hole made in the vehicle body, so that the antenna apparatus 1 can be tentatively joined so as not to drop out.

Figure 24:
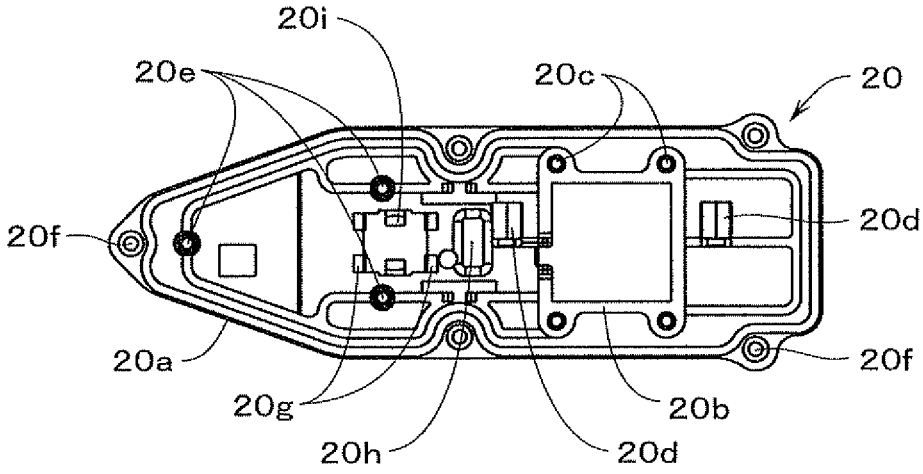
FIG. 24 is a plan view illustrating a configuration of an antenna base in the antenna apparatus according to an embodiment of the invention.
Figure 25:
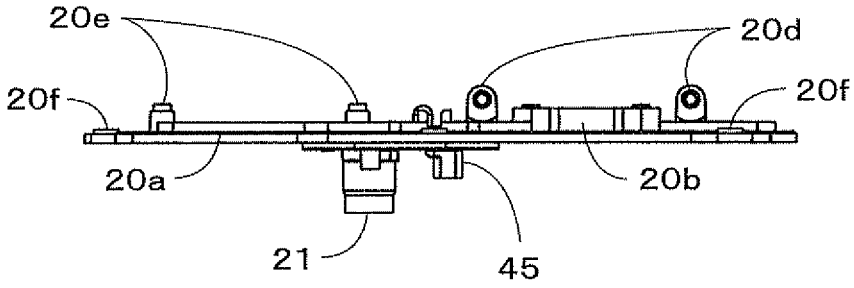
FIG. 25 is a front view illustrating the configuration of the antenna base in the antenna apparatus according to an embodiment of the invention.
Figure 26:
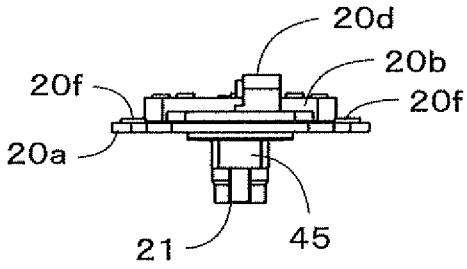
FIG. 26 is a right side view illustrating the configuration of the antenna base in the antenna apparatus according to an embodiment of the invention.

FIGS. 24 to 26 illustrate a configuration of the antenna base 20. FIG. 24 is a plan view illustrating the configuration of the antenna base 20, FIG. 25 is a front view illustrating the configuration of the antenna base 20, and FIG. 26 is a right side view illustrating the configuration of the antenna base 20. The antenna base 20 of FIGS. 24 to 26 includes a body portion 20*a*, and the body portion 20*a* includes a substantially rectangular flat plate whose front portion is tapered. Five fitting holes 20*f* are made in the peripheral portion of the body portion 20*a*. The screws 46 inserted into the fitting holes 20*f* from below are engaged with the surrounding portion in the lower surface of the antenna case 10, thereby fitting the antenna case 10 in the antenna base 20. The three bosses 20*e* are formed in the tapered front portion of the body portion 20*a*, and the amplifier board 34 is placed on the bosses 20*e* to engage the screws 42 inserted into the amplifier board 34 with the bosses 20*e*, which allows the amplifier board 34 to be fixed to the antenna base 20.

Two screw portions 20*d* are horizontally formed in the substantially central portion and the rear portion side of the body portion 20*a*. The screws 41 inserted into the mounting holes of the antenna board 30 are engaged with the screw portions 20*d*, which allows the antenna board 30 to be vertically mounted on the antenna base 20. A GPS antenna mounting portion 20*b* is formed on the slightly rear portion side from the center of the body portion 20*a*, and the GPS antenna mounting portion 20*b* has a rectangular frame shape in which a rectangular recess is formed. Screw holes 20*c* are made in for corners of the GPS antenna mounting portion 20*b*. The four screws inserted into the mounting holes of the GPS antenna 32 are engaged in the screw holes 20*c*, which allows the GPS antenna 32 to be mounted in the GPS antenna mounting portion 20*b*. A rectangular cable lead hole 20*h* is made in the central portion of the body portion 20*a*. The cable 22 led out from the amplifier board 34 and the cable led out from the GPS antenna 32 can be led out from the cable lead hole 20*h*.

Four first rectangular holes 20*g* and two second rectangular holes 20*i* are also made on the slightly front portion side from the center of the body portion 20*a*. The four fitting leg portions 44*b* of the hook 44 are inserted into the first rectangular holes 209, respectively, and the leading ends of the fitting leg portions 44*b* are engaged with the rear surface of the antenna base 20, thereby mounting the hook 44 on the antenna base 20. The two engagement leg portions 44*c* of the hook 44 are inserted into the second rectangular holes 20*i*, respectively, and the engagement leg portions 44*c* are projected along the bolt portion 21 from the lower surface of the antenna base 20. The bolt portion 21 is projected from the rear surface of the body portion 20*a*, and the collar 45 is provided in the rear surface of the body portion 20*a* in order to bundle the cables 22 led out from the cable lead hole 20*h*.

Figure 27:
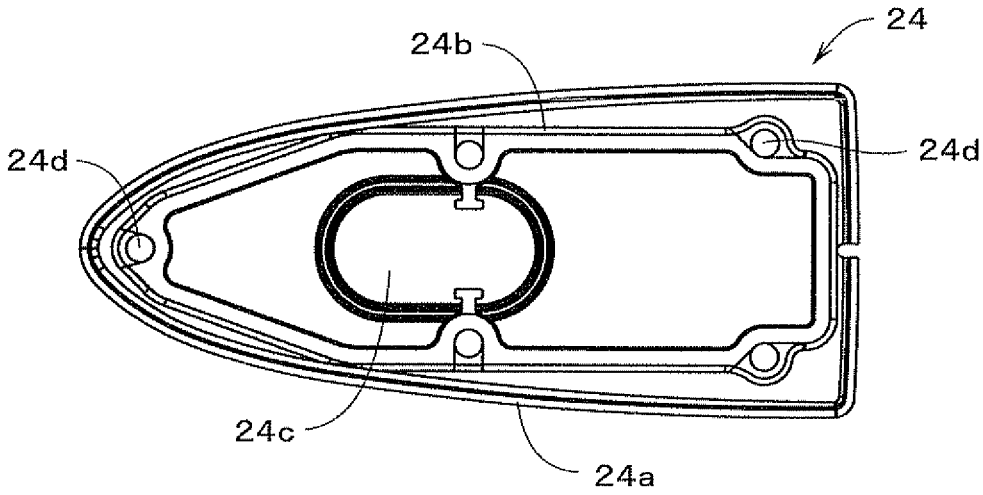
FIG. 27 is a plan view illustrating a configuration of a base pad in the antenna apparatus according to an embodiment of the invention.
Figure 28:
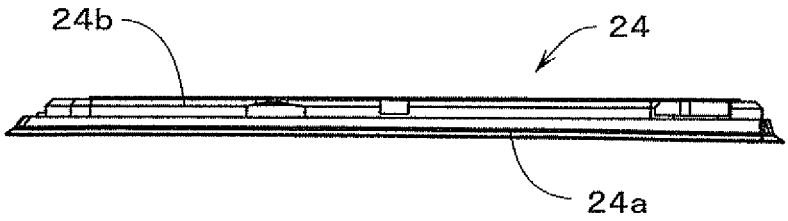
FIG. 28 is a front view illustrating the configuration of the base pad in the antenna apparatus according to an embodiment of the invention.
Figure 29:
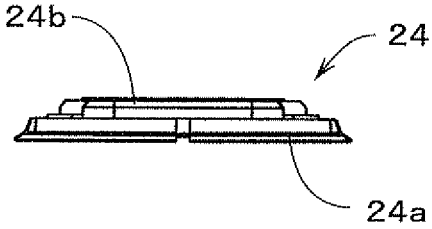
FIG. 29 is a right side view illustrating the configuration of the base pad in the antenna apparatus according to an embodiment of the invention.

FIGS. 27 to 29 illustrate a configuration of the base pad 24. FIG. 27 is a plan view illustrating the configuration of a base pad 24, FIG. 28 is a front view illustrating the configuration of the base pad 24, and FIG. 29 is a right side view illustrating the configuration of the base pad 24. The base pad 24 of FIGS. 27 to 29 is formed into a curved surface that is gradually thinned toward the front portion. The base pad 24 includes a planar body portion 24*a* having a shape of a half of long, thin ellipsoid whose rear end is linearly cut. A circumferential wall portion 24*b* is formed in the surface of the body portion 24*a*, and the circumferential wall portion 24*b* has a shape similar to an external form of the antenna base 20. The antenna base 20 is placed on the surface of the base pad 24, and the periphery of the antenna base 20 is fitted in the circumferential wall portion 24*b*, thereby fitting the base pad 24 in the lower surface of the antenna base 20. Five hole portions 24*d* are formed along the circumferential wall portion 24*b*, and the heads of the screws 46 inserted into the fitting holes 20*f* of the antenna base 20 from above are inserted into the hole portions 24*d*. An ellipsoidal notch hole 24*c* is made from the center of the body portion 24*a* to the front portion, and the bolt portion 21, the cable 22, and the collar 45, which are provided in the lower surface of the antenna base 20, are projected from the notch hole 24*c*.

Figure 30:
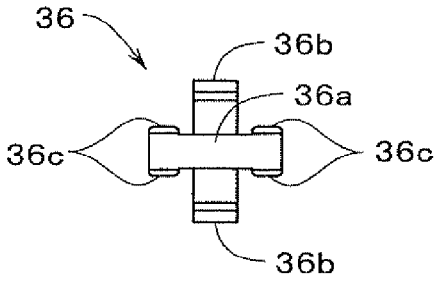
FIG. 30 is a plan view illustrating a configuration of connecting hardware in the antenna apparatus according to an embodiment of the invention.
Figure 31:
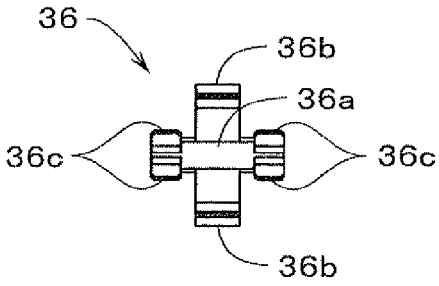
FIG. 31 is a bottom view illustrating the configuration of the connecting hardware in the antenna apparatus according to an embodiment of the invention.
Figure 32:
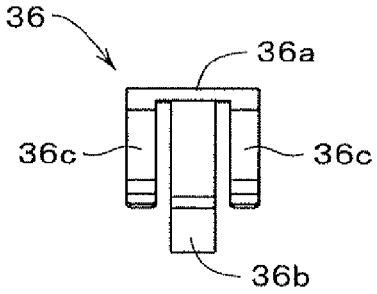
FIG. 32 is a front view illustrating the configuration of the connecting hardware in the antenna apparatus according to an embodiment of the invention.
Figure 33:
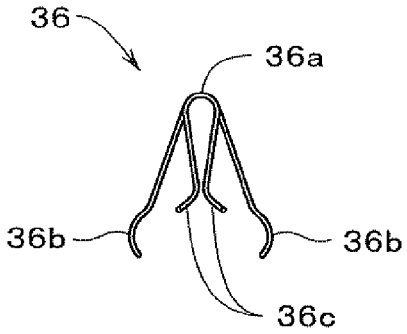
FIG. 33 is a side view illustrating the configuration of the connecting hardware in the antenna apparatus according to an embodiment of the invention.

FIGS. 30 to 33 illustrate a configuration of the connecting hardware 36. FIG. 30 is a plan view illustrating the configuration of the connecting hardware 36, FIG. 31 is a bottom view illustrating the configuration of the connecting hardware 36, FIG. 32 is a front view illustrating the configuration of the connecting hardware 36, and FIG. 33 is a side view illustrating the configuration of the connecting hardware 36. The connecting hardware 36 of FIGS. 30 to 33 is formed by processing the elastic metal plate, and the connecting hardware 36 includes a clipping body 36*a*. The clipping body 36*a* is bent such that the central portion of the clipping body 36*a* is folded. Clipping pieces 36*c* are formed on both sides in the front portion and rear portion of the clipping body 36*a*. The two clipping pieces 36*c* are disposed while facing each other, leading ends of the two clipping pieces are in contact with each other, and the leading ends are processed so as to be opened. Contact pieces 36*b* are formed opposite each other between the two sets of clipping pieces 36*c*, and the contact piece 36*b* is longer than the clipping piece 36*c*. The contact pieces 36*b* are formed so as to be spread downward, and the leading end portion of the contact piece 36*b* is curled into a semicircular shape. The connecting hardware 36 is mounted so as to clip the upper end of the antenna board 30. At this point, because the leading ends of the pair of clipping pieced 36*c* are opened, the upper end of the antenna board 30 can easily be inserted between the clipping pieces 36*c*. When the connecting hardware 36 is inserted into the upper portion of the antenna board 30, the connecting hardware 36 is electrically connected to the antenna pattern formed in the upper portion of the antenna board 30. When the antenna case 10 is fitted in the antenna base 20, the spread contact pieces 36*b* come into contact with the inner surfaces of the contact pieces 31*c* of the top portion 31 mounted in the antenna case 10. Therefore, the top portion 31 is electrically connected to the antenna pattern through the connecting hardware 36.

Figure 34:
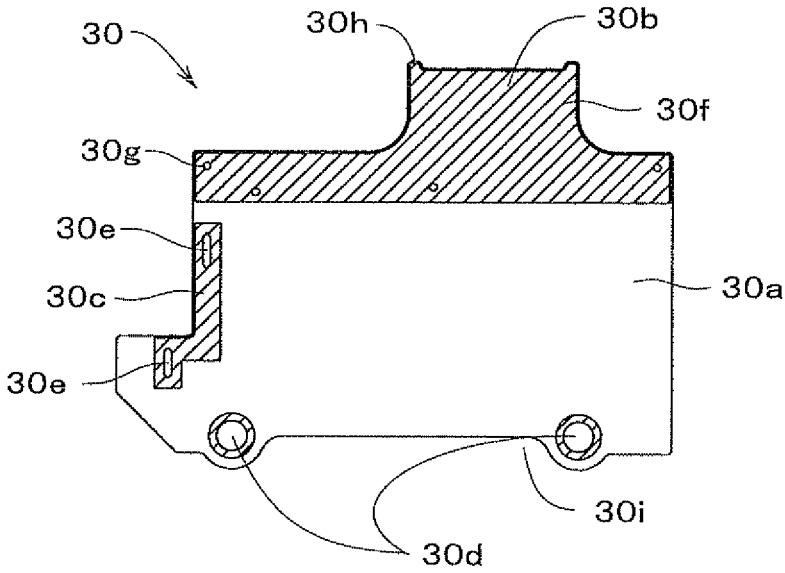
FIG. 34 is a front view illustrating a configuration of an antenna board in the antenna apparatus according to an embodiment of the invention.
Figure 35:
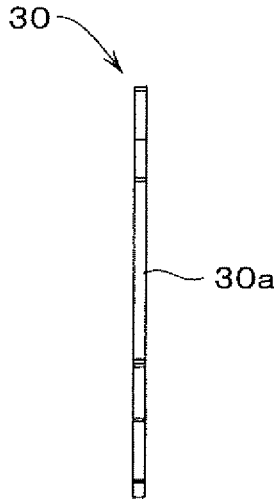
FIG. 35 is a front view illustrating the configuration of the antenna board in the antenna apparatus according to an embodiment of the invention.

FIGS. 34 and 35 illustrate a configuration of the antenna board 30. FIG. 34 is a front view illustrating the configuration of the antenna board 30, and FIG. 35 is a front view illustrating the configuration of the antenna board 30. The antenna board 30 of FIGS. 34 and 35 includes a board body 30*a* that is of a print board such as a glass epoxy board having a good high-frequency characteristic. A projection portion 30*f* that is projected from an upper portion of a rectangular portion and a portion that is projected leftward from a bottom left portion are formed in board body 30*a*. In the upper portion of the board body 30*a* and the projection portion 36*f*, antenna patterns 30*b* are formed in both surfaces. In the periphery on the left side, long, thin patterns are formed in both surfaces from below the antenna pattern 30*b* to the projected bottom left portion. The connecting hardware 36 is attached to the projection portion 30*f*, and protrusions 30*h* are formed on both sides at upper end of the projection portion 30*f* in order to position the connecting hardware 36. Two mounting holes 30*d* are made in the lower portion of the board body 30*a*, and a notch 30*i* is formed between the mounting holes 30*d*. A ring-shape patterns are formed around the mounting hole 30*d* in both surfaces. The screw 41 is inserted into the mounting hole 30*d* and engaged with the screw portion 20*d* of the antenna base 20, whereby the antenna board 30 is vertically mounted on the antenna base 20. The GPS antenna 32 is mounted on the antenna base 20 so as to be partially accommodated in the notch 30*i*.

One of the lead wires 35*b* of the coil 35 is inserted into a hole portion 30*g* formed on the left side of the antenna pattern 30*b*, and one of the lead wires 35*b* is soldered to the antenna pattern 30*b*. The other lead wire 35*b* is inserted into a long hole 30*e* made in the upper portion of the pattern 30*c*, and the other lead wire 35*b* is soldered to the pattern 30*c*. Therefore, the antenna pattern 30*b* is connected to the AM/FM amplifier through the coil 35, the pattern 30*c*, and the connecting wire 33. The AM/FM amplifier is provided on the amplifier board 34 to which the U-shape portion 33*c* of the connecting wire 33 is connected.

Figure 36:
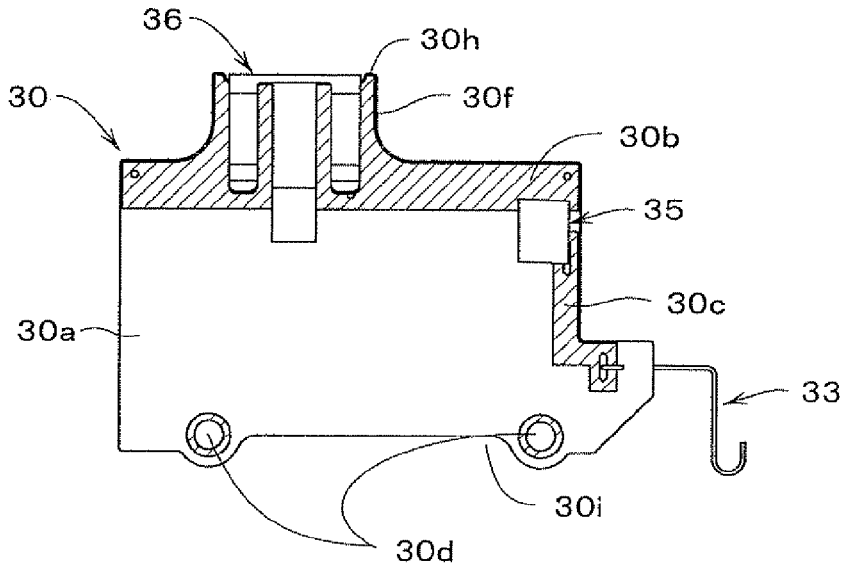
FIG. 36 is a view illustrating a state in which the connecting hardware, the coil, and the connecting wire are mounted in the antenna board of the antenna apparatus according to an embodiment of the invention.

FIG. 36 illustrates the state in which the connecting hardware 36, the coil 35, and the connecting wire 33 are mounted in the antenna board 30. As illustrated in FIG. 36, the connecting hardware 36 is disposed between the protrusions 30*h* of the projection portion 30*f* so as to clip the projection portion 30*f* in the upper portion of the antenna board 30. The coil 35 is soldered between the hole portion 30*g* of the antenna pattern 30*b* and the long hole 30*e* of the pattern 30*c*. The U-shape portion 33*b* of the connecting wire 33 is soldered to the long hole 30*e* of the pattern 30*c*.

Figure 37:
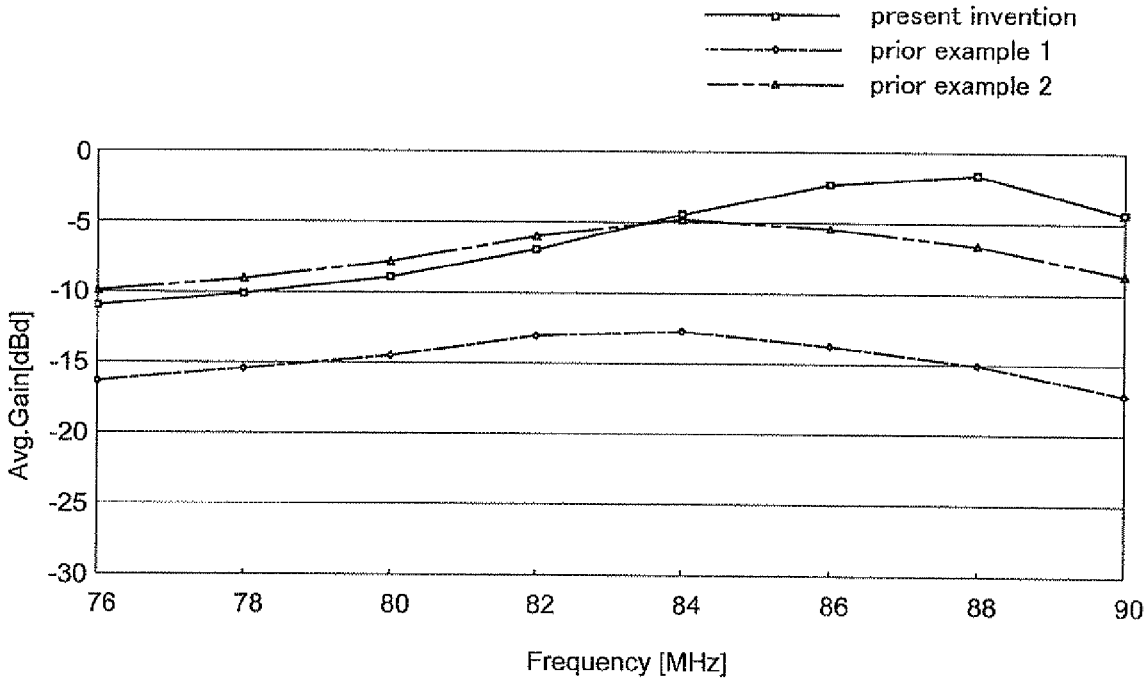
FIG. 37 is a view illustrating a frequency characteristic of an average gain in an FM waveband of the antenna apparatus according to an embodiment of the invention in comparison with a prior antenna apparatus.
Figure 70:
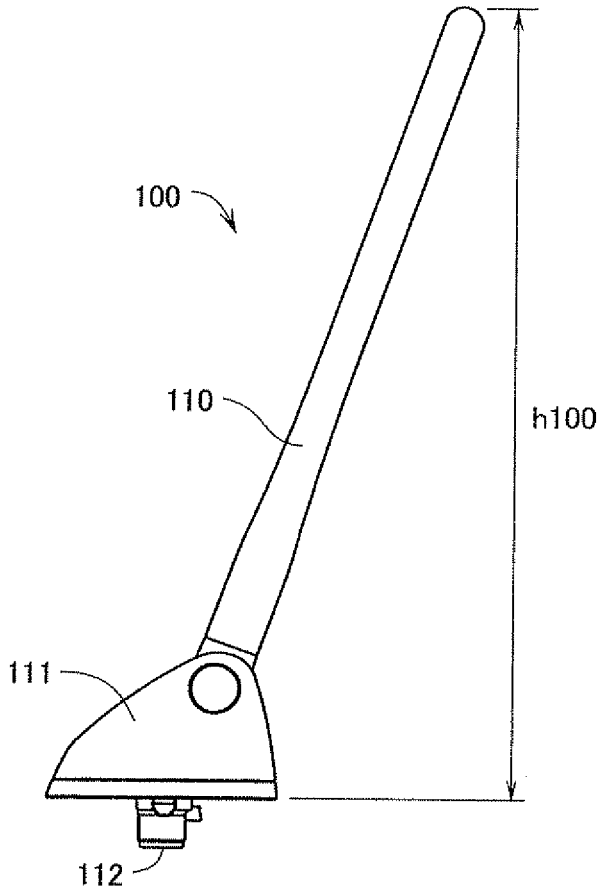
FIG.70 Prior art
FIG. 70 is a side view illustrating a configuration of a prior antenna apparatus.
Figure 71:
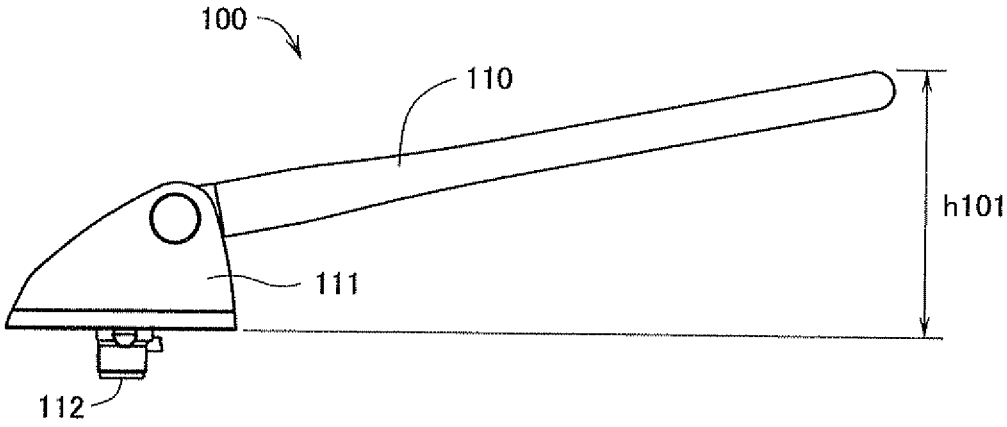
FIG.71 Prior art
FIG. 71 is a side view illustrating a configuration of the prior antenna apparatus when a height of the antenna apparatus is decreased.

In the antenna apparatus 1 according to an embodiment of the invention, the distance h10 between the top portion 31 and the antenna base 20 is set at about 34.4 mm. In the size of the top portion 31 of FIGS. 15 to 18, the length L20 is set at about 106 mm, the width w20 at the rear end is set at about 28 mm, the width w21 at the front end is set at about 19 mm, the height h20 is set at about 28 mm, and the width w22 is set at about 4 mm. At this point, FIG. 37 illustrates a frequency characteristic of an average gain of the antenna apparatus 1 in comparison with the prior example of FIGS. 70 and 71. The frequency characteristic of the average gain of FIG. 37 in the antenna apparatus 1 is obtained in the FM waveband of 76 MHz to 90 MHz. In a prior example 1, the total height h100 of the prior antenna apparatus 100 is set at about 195 mm (see FIG. 70). In prior example 2, the total height h100 is set at about 70 mm (see FIG. 71). Referring to the frequency characteristic of the average gain of the antenna apparatus 1 for the prior examples 1 and 2, when the total height h100 is reduced from about 195 mm to about 70 mm, the average gain is degraded by about 7 dB over the frequency band of the FM waveband. Referring to FIG. 37, in mounting the antenna apparatus 1 according to an embodiment of the invention, even if the projected height h is set at about 70 mm, the frequency characteristic of the average gain equal to that of the prior example 1 in which the total height h100 is set at about 195 mm, and particularly the average gain is improved in the high-frequency region of about 84 MHz or more.

Figure 38:
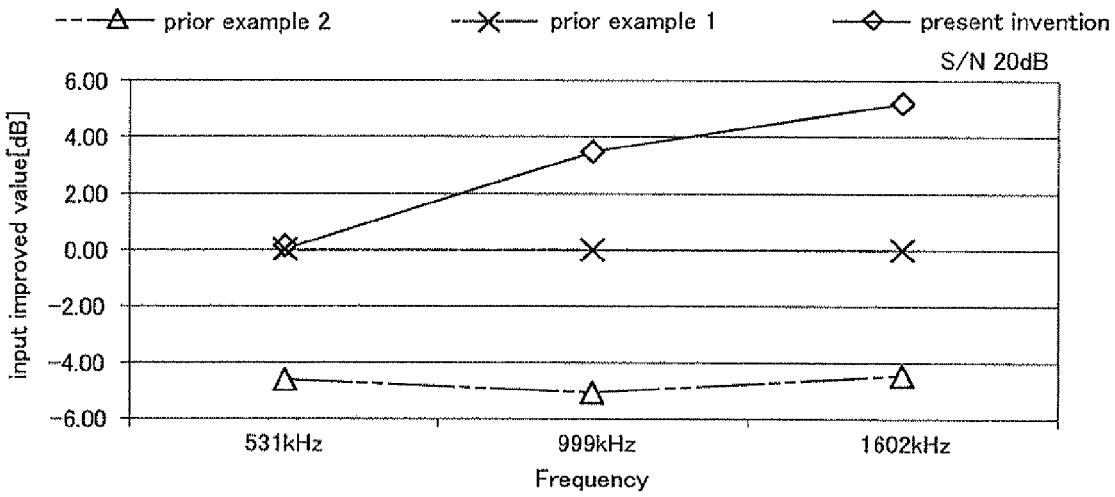
FIG. 38 is a view illustrating a frequency characteristic of an S/N ratio in an AM waveband of the antenna apparatus according to an embodiment of the invention in comparison with a prior antenna apparatus.

FIG. 38 illustrates a frequency characteristic of an S/N ratio in the AM waveband of the antenna apparatus 1 according to an embodiment of the invention having the above-described dimensions in comparison with the prior examples 1 and 2. The frequency characteristic of the S/N ratio of FIG. 38 is obtained in the AM waveband of 531 kHz to 1602 kHz. In FIG. 38, based on the antenna apparatus 100 of the prior example 1, an antenna input value in which the S/N ratio of 20 dB is obtained in the antenna apparatus 100 of the prior example 1 is standardized to 0 dB, an antenna input value in which the S/N ratio of 20 dB is obtained in the antenna apparatus 1 according to an embodiment of the invention and the antenna apparatus 100 of the prior example 2 is illustrated as an input improved value [dB] with respect to the standardized antenna input value. Referring to the frequency characteristics of the input improved values of the prior examples 1 and 2, when the total height h100 is reduced from about 195 mm to about 70 mm, the input improved value is degraded by about 4.5 dB to about 5 dB over the frequency band of the AM waveband. That is, the S/N ratio is degraded. Referring to FIG. 38, in the antenna apparatus 1 according to an embodiment of the invention, even if the height h is set at about 70 mm, the frequency characteristic of the input improved value equal to or better than that of the prior example 1 in which the total height h100 is set at about 195 mm, the input improved value is increased with increasing frequency, and the S/N ratio is improved.

Figure 39:
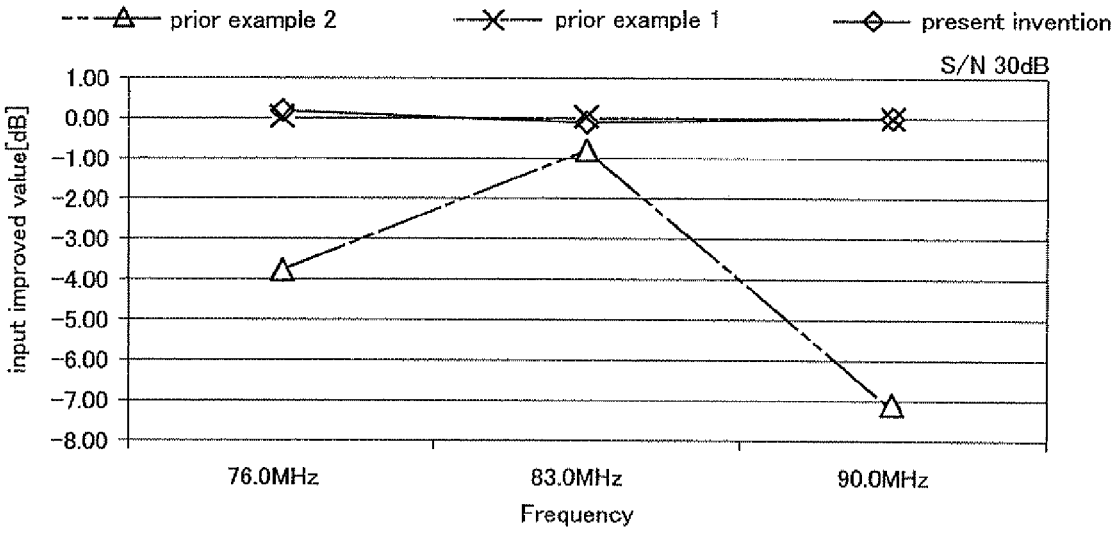
FIG. 39 is a view illustrating a frequency characteristic of an S/N ratio in the FM waveband of the antenna apparatus according to an embodiment of the invention in comparison with a prior antenna apparatus.

FIG. 39 illustrates a frequency characteristic of an S/N ratio of the FM broadcast received signal in the antenna apparatus 1 according to an embodiment of the invention having the above-described dimensions in comparison with the prior examples 1 and 2. The frequency band of FIG. 39 is the FM waveband of 76 MHz to 90 MHz. In FIG. 39, an antenna input value in which the S/N ratio of 30 dB is obtained in the antenna apparatus 100 of the prior example 1 is standardized to 0 dB, an antenna input value in which the S/N ratio of 30 dB is obtained in the antenna apparatus 1 according to an embodiment of the invention and the antenna apparatus 100 of the prior example 2 is illustrated as an input improved value [dB] with respect to the standardized antenna input value. Referring to the frequency characteristics of the input improved values of the prior examples 1 and 2, when the total height h100 is reduced from about 195 mm to about 70 mm, the input improved value is degraded by about 4 dB in the low frequency region (76 MHz) of the FM waveband, and the input improved value is degraded by about 1 dB in the middle frequency region (83 MHz) of the FM waveband. The input improved value is further degraded from the middle frequency region to the high frequency region, and the input improved value is degraded by about 7 dB at 90 MHz. Referring to FIG. 39, in the antenna apparatus 1 according to an embodiment of the invention, even if the height h is set at about 70 mm, the frequency characteristic of the input improved value equal to that of the prior example 1 in which the total height h100 is set at about 195 mm, and the S/N ratio is improved.

Figure 40:
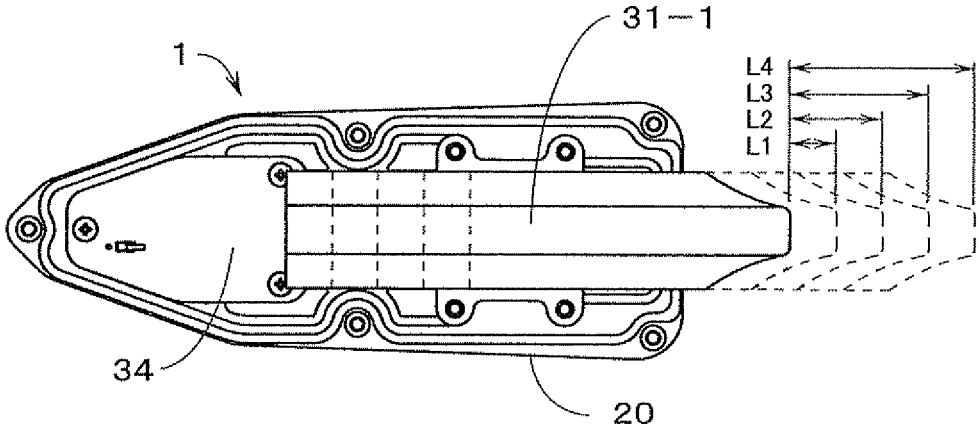
FIG. 40 is a plan view illustrating a configuration of an antenna apparatus used in a basic experiment of a top portion rearward projection length.
Figure 41:
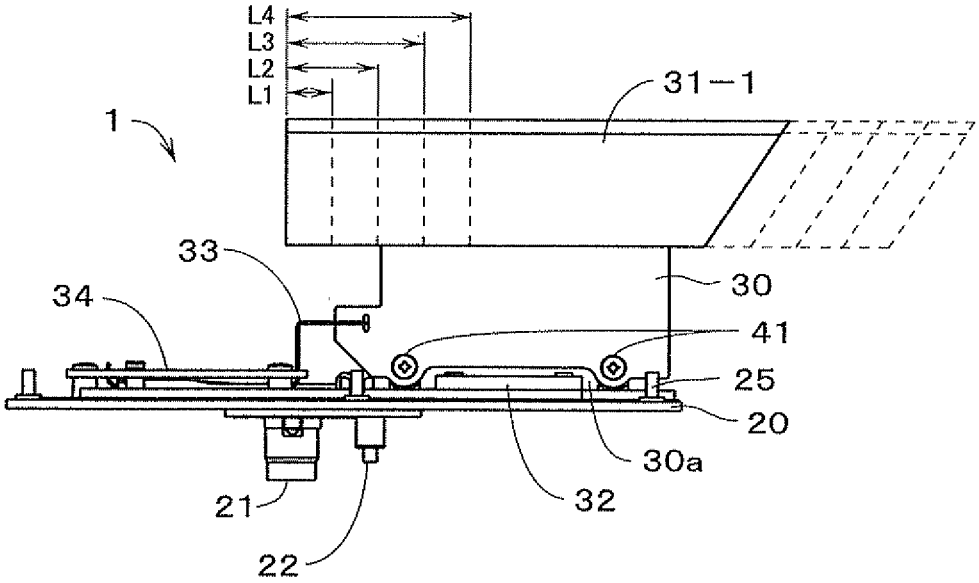
FIG. 41 is a front view illustrating the configuration of the antenna apparatus used in the basic experiment of the top portion rearward projection length.
Figure 42:
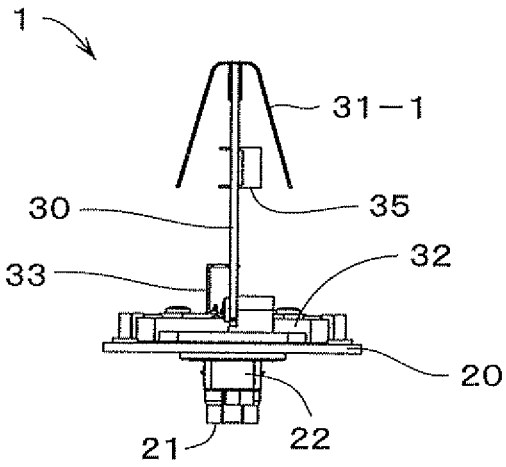
FIG. 42 is a right side view illustrating the configuration of the antenna apparatus used in the basic experiment of the top portion rearward projection length.
Figure 43:
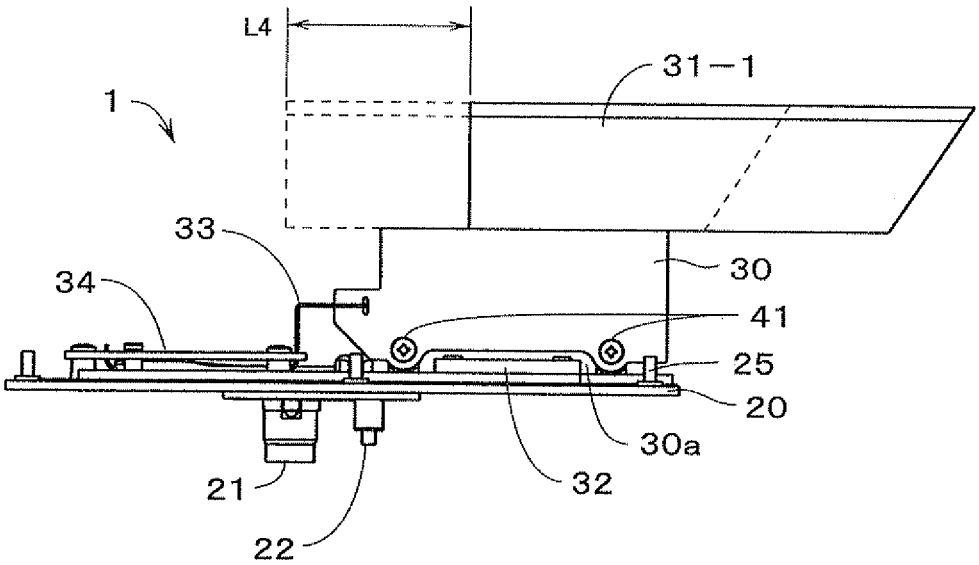
FIG. 43 is a plan view illustrating a mode of the antenna apparatus used in the basic experiment of the top portion rearward projection length.

In the antenna apparatus 1 according to an embodiment of the invention, when the top portion 31 is projected rearward from a rear end of the antenna base 20, the average gain and the S/N ratio are improved. FIGS. 40 to 43 illustrate a mode of the antenna apparatus 1 in a basic experiment when the top portion 31 is projected rearward from the rear end of the antenna base 20, and FIGS. 44 to 50 illustrate pieces of data obtained in the basic experiment. FIG. 40 is a plan view illustrating the configuration of the antenna apparatus 1 used in the basic experiment, FIG. 41 is a front view illustrating the configuration of the antenna apparatus 1 used in the basic experiment, and FIG. 42 is a right side view illustrating the configuration of the antenna apparatus 1 used in the basic experiment. As illustrated in FIGS. 40 to 42, although a shape of a top portion 31-1 in the antenna apparatus 1 differs slightly from that of the top portion 31 according to an embodiment of the invention, the length and the width of the top portion 31-1 are substantially similar to those of the top portion 31, and the antenna apparatus 1 FIGS. 40 to 42 has the substantially similar electrical performance as the antenna element. In the top portion 31-1, the apex portion is substantially flatly formed, and both side portions are formed as the inclined plane that is steeply inclined downward. The rear portion of the top portion 31-1 is obliquely cut in order to reduce the area facing the antenna base 20 as much as possible. In the basic experiment of the top portion rearward projection length, as illustrated in FIGS. 40 and 41, a movement amount L of the top portion 31-1 from a standard position is changed rearward to L1, L2, L3, and L4. At this point, the movement amounts L1, L2, L3, and L4 are set at about 10 mm, about 20 mm, about 30 mm, and about 40 mm, respectively. FIG. 43 is a plan view illustrating a configuration when the movement amount L of the top portion 31-1 is set at about 40 mm (L4).

Figure 44:
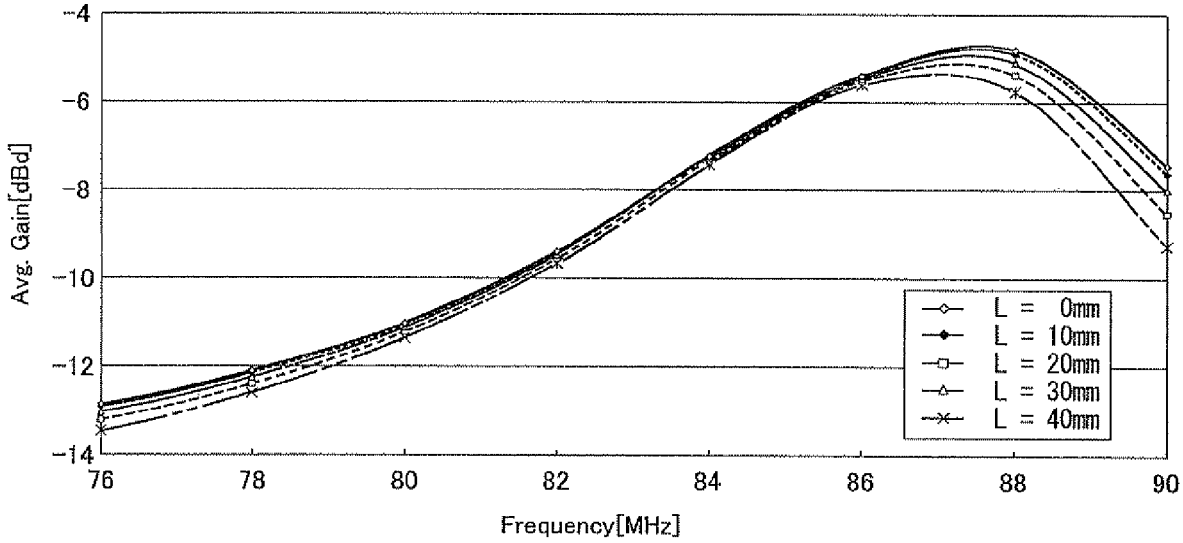
FIG. 44 is a view illustrating a frequency characteristic of the average gain in the FM waveband when the top portion is moved rearward from a standard position while a movement amount L is changed.

FIG. 44 illustrates a frequency characteristic of the average gain in the FM waveband when the top portion 31-1 is moved rearward from the standard position while the movement amount L is changed to L1, L2, L3, and L4. The frequency band of the average gain of FIG. 44 is the FM waveband of 76 MHz to 90 MHz. Referring to FIG. 44, the frequency characteristic of the average gain is improved as the movement amount L of the top portion 31-1 is changed rearward to from 0 mm to about 10 mm, about 20 mm, about 30 mm, and about 40 mm. When the case where the rearward movement amount L of the top portion 31-1 is set at 0 mm is compared to the case where the rearward movement amount L of the top portion 31-1 is set at 40 mm, the frequency characteristic of the average gain is improved up to about 4 dB within the frequency band of the FM waveband in the case where the movement amount L is set at about 40 mm.

Figure 45:
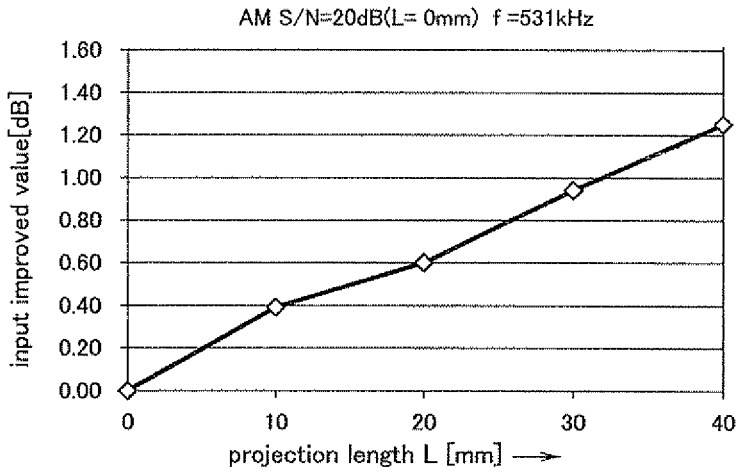
FIG. 45 is a view illustrating a change in characteristic of the S/N ratio in the AM waveband when the top portion is moved rearward from the standard position while the movement amount L is changed.
Figure 46:
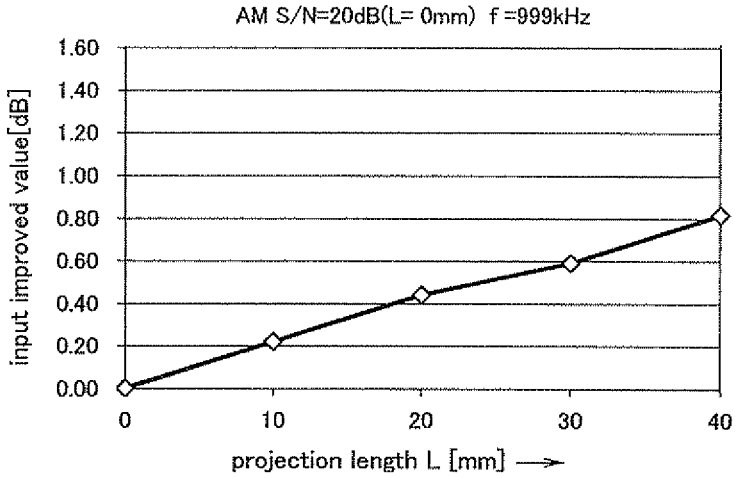
FIG. 46 is another view illustrating the change in characteristic of the S/N ratio in the AM waveband when the top portion is moved rearward from the standard position while the movement amount L is changed.
Figure 47:
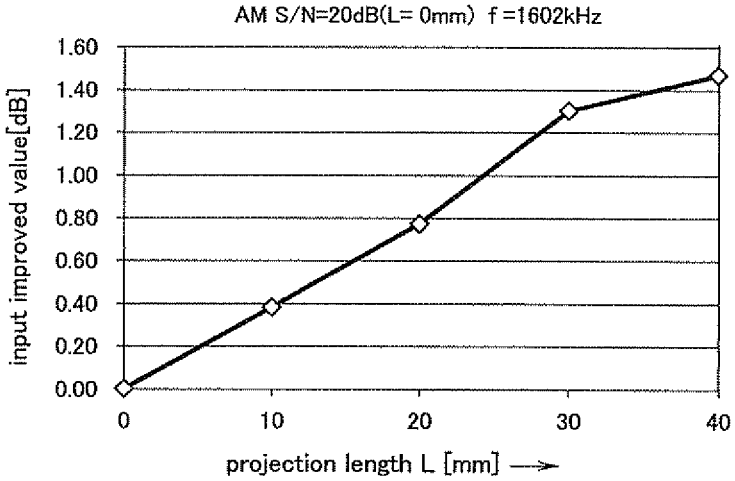
FIG. 47 is still another view illustrating the change in characteristic of the S/N ratio in the AM waveband when the top portion is moved rearward from the standard position while the movement amount L is changed.

FIGS. 45 to 47 illustrate changes in characteristic of the S/N ratio in the AM waveband when the top portion 31-1 is moved rearward from the standard position while the movement amount L is changed to L1, L2, L3, and L4. In FIGS. 45 and 47, at the frequency in the AM waveband, the antenna input value in which the S/N ratio of 20 dB is obtained is standardized to 0 dB based on the movement amount L of the top portion 31-1 of 0 mm, and the antenna input value in which the S/N ratio of 20 dB is obtained when the movement amount L is changed from 0 mm to about 10 mm, about 20 mm, about 30 mm, and about 40 mm is illustrated as an input improved value [dB] with respect to the standardized antenna input value. FIG. 45 is a view illustrating a change in characteristic of the S/N ratio in the AM waveband when the top portion is moved rearward from the standard position while the movement amount L is changed. FIG. 45 illustrates an input improved value with respect to a projection length L that is of the movement amount L when the frequency is set at a lower limit of 531 kHz. FIG. 46 illustrates an input improved value with respect to the projection length L that is of the movement amount L when the frequency is set at a substantially central frequency of 999 kHz. FIG. 47 illustrates an input improved value with respect to the projection length L that is of the movement amount L when the frequency is set at an upper limit of 1602 kHz. Referring to FIGS. 45 to 47, at the frequency of 531 kHz, the input improved value is increased with increasing projection length L, and the input improved value is increased by about 1.3 dB when the projection length L is set at 40 mm. At the frequency of 999 kHz, the input improved value is increased with increasing projection length L, and the input improved value is increased by about 0.8 dB when the projection length L is set at 40 mm. At the frequency of 1602 kHz, the input improved value is increased with increasing projection length L, and the input improved value is increased by about 1.5 dB when the projection length L is set at 40 mm. Thus, in the AM waveband, the S/N ratio is improved with increasing projection length L.

Figure 48:
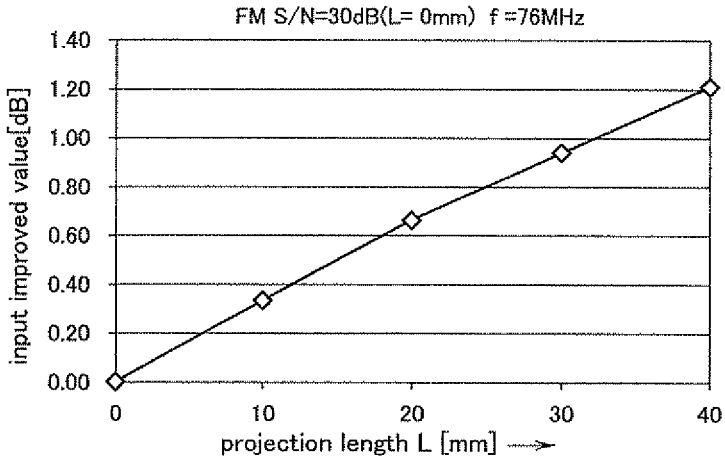
FIG. 48 is a view illustrating a change in characteristic of the S/N ratio in the FM waveband when the top portion is moved rearward from the standard position while the movement amount L is changed.
Figure 49:
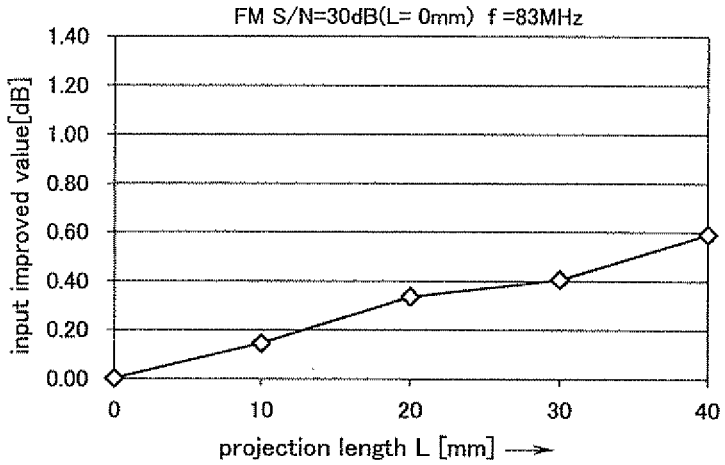
FIG. 49 is another view illustrating the change in characteristic of the S/N ratio in the AM waveband when the top portion is moved rearward from the standard position while the movement amount L is changed.
Figure 50:
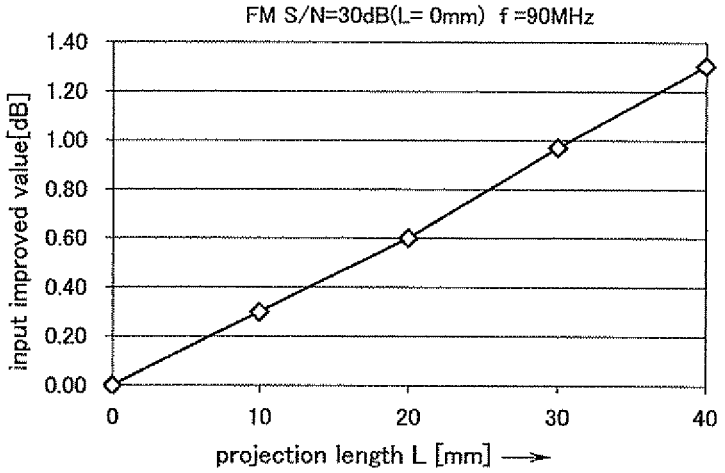
FIG. 50 is still another view illustrating the change in characteristic of the S/N ratio in the AM waveband when the top portion is moved rearward from the standard position while the movement amount L is changed.

FIGS. 48 to 50 illustrate a frequency characteristic of the S/N ratio in the FM waveband when the top portion 31-1 is moved rearward from the standard position while the movement amount L is changed to L1, L2, L3, and L4. In FIGS. 48 and 50, at the frequency in the FM waveband, the antenna input value in which the S/N ratio of 30 dB is obtained is standardized to 0 dB based on the movement amount L of the top portion 31-1 of 0 mm, and the antenna input value in which the S/N ratio of 30 dB is obtained when the movement amount L is changed from 0 mm to about 10 mm, about 20 mm, about 30 mm, and about 40 mm is illustrated as an input improved value [dB] with respect to the standardized antenna input value. FIG. 48 illustrates an input improved value with respect to the projection length L that is of the movement amount L when the frequency is set at a lower limit of 76 MHz. FIG. 49 illustrates an input improved value with respect to the projection length L that is of the movement amount L when the frequency is set at a substantially central frequency of 83 MHz. FIG. 50 illustrates an input improved value with respect to the projection length L that is of the movement amount L when the frequency is set at an upper limit of 90 MHz. Referring to FIGS. 48 to 50, at the frequency of 76 MHz, the input improved value is increased with increasing projection length L, and the input improved value is increased by about 1.1 dB when the projection length L is set at 40 mm. At the frequency of 83 MHz, the input improved value is increased with increasing projection length L, and the input improved value is increased by about 0.6 dB when the projection length L is set at 40 mm. At the frequency of 90 MHz, the input improved value is increased with increasing projection length L, and the input improved value is increased by about 1.3 dB when the projection length L is set at 40 mm. Thus, in the FM waveband, the S/N ratio is improved with increasing projection length L.

As can be seen from the basic experiment, as the top portion 31 is moved rearward, the distance from the ground is increased to reduce the floating capacitance between the ground and the top portion 31, and the gain and the S/N ratio are improved both in the AM waveband and the FM waveband.

Figure 51:
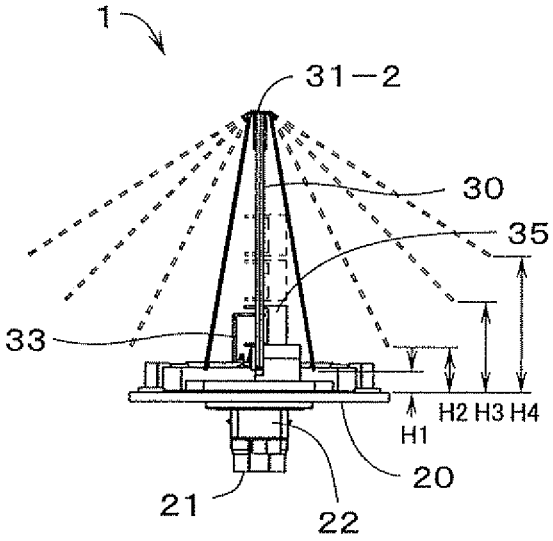
FIG. 51 is a right side view illustrating a configuration of the antenna apparatus used in a basic experiment in which a height of the top portion from an antenna base is changed.
Figure 52:
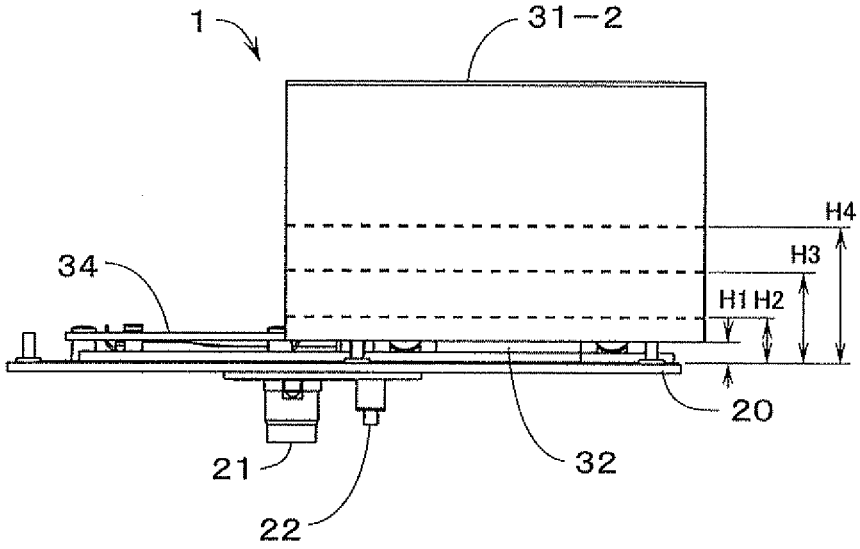
FIG. 52 is a front view illustrating the configuration of the antenna apparatus used in the basic experiment in which the height of the top portion from an antenna base is changed.
Figure 53:
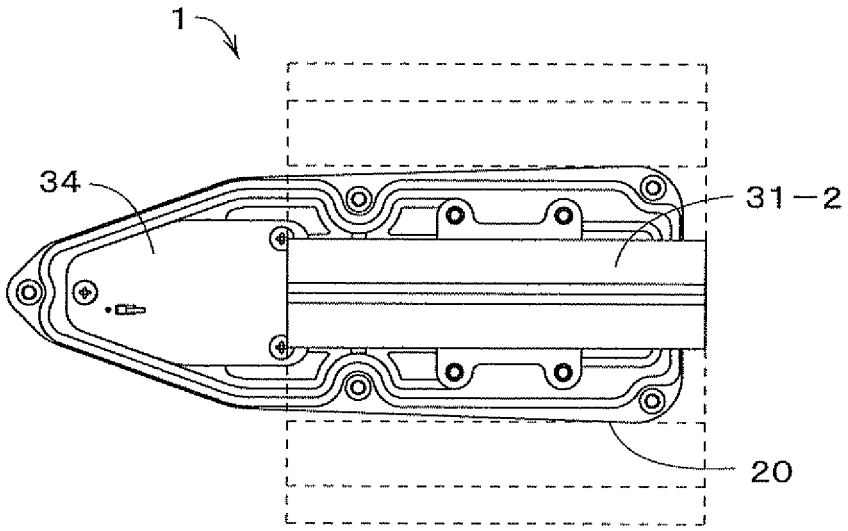
FIG. 53 is a plan view illustrating the configuration of the antenna apparatus used in the basic experiment in which the height of the top portion from an antenna base is changed.
Figure 54:
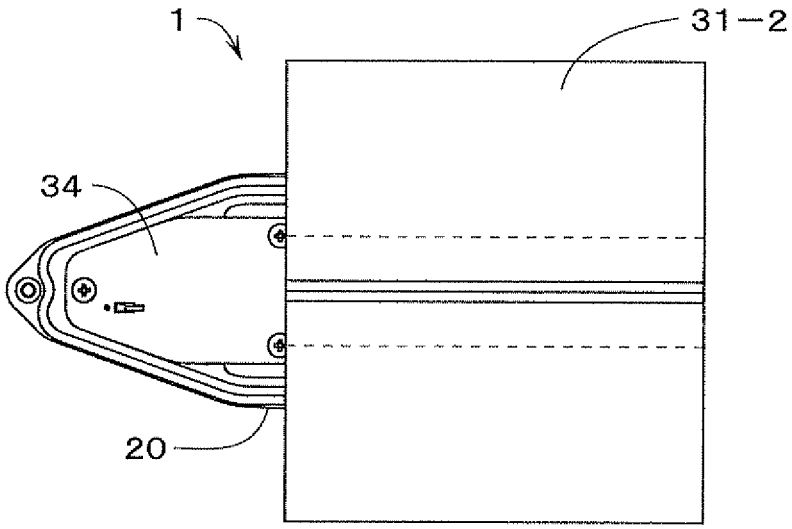
FIG. 54 is a plan view illustrating a mode of the antenna apparatus used in the basic experiment in which the height of the top portion from an antenna base is changed.
Figure 55:
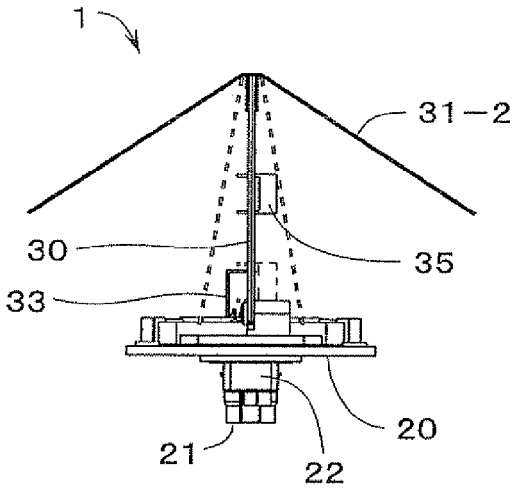
FIG. 55 is a right side view illustrating the mode of the antenna apparatus used in the basic experiment in which the height of the top portion from an antenna base is changed.

A basic experiment in which basic experimental data of the average gain and S/N ratio is obtained in changing a height H between the top portion 31 and the antenna base 20 in the antenna apparatus 1 according to an embodiment of the invention will be described below. FIGS. 51 to 55 illustrate a mode of the antenna apparatus 1 in the basic experiment in which the height H of the top portion 31 from the antenna base 20 is changed, and FIGS. 56 to 62 illustrate pieces of basic experimental data obtained in the basic experiment. FIG. 51 is a right side view illustrating a configuration of the antenna apparatus 1 used in the basic experiment, FIG. 52 is a front view illustrating the configuration of the antenna apparatus 1 used in the basic experiment, and FIG. 53 is a plan view illustrating the configuration of the antenna apparatus 1 used in the basic experiment. As illustrated in FIGS. 51 to 53, a shape of a top portion 31-2 in the antenna apparatus 1 differs slightly from that of the top portion 31 according to an embodiment of the invention. The sizes of both side portions of the top portion 31-1 used in the basic experiment, in which the top portion is moved rearward, are enlarged in the shape of the top portion 31-2. In the side portions of the top portion 31-2 have the inclined planes that are steeply inclined downward, the horizontal size is about 50 mm, and the downward size in the inclined plane is about 60 mm. In the basic experiment of the top portion height, as illustrated in FIGS. 51 to 53, the height H of the top portion 31-2 from the antenna base 20 is increased to H1, H2, H3, and H4, and the heights H1, H2, H3, and H4 are set at about 5 mm, about 10 mm, about 20 mm, and about 30 mm, respectively. FIG. 54 is a plan view illustrating the configuration when the height H of the top portion 31-2 is set at about 30 mm (H4), and FIG. 55 is a right side view illustrating the configuration when the height H of the top portion 31-2 is set at about 30 mm (H4).

Figure 56:
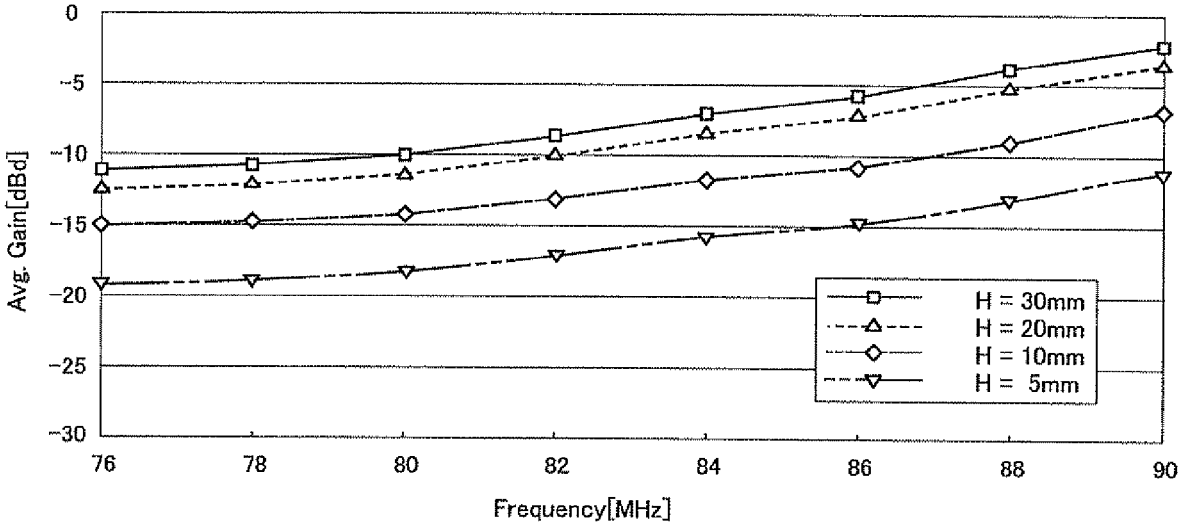
FIG. 56 is a view illustrating a frequency characteristic of the average gain in the FM waveband when a top portion height is gradually increased.

FIG. 56 is a view illustrating a frequency characteristic of the average gain in the FM waveband when the height of the top portion 31-2 is gradually increased to H1, H2, H3, and H4. The frequency band of the average gain of FIG. 56 is the FM waveband of 76 MHz to 90 MHz. Referring to FIG. 56, the frequency characteristic of the average gain is gradually improved as the height H of the top portion 31-2 from the antenna base 20 is increased from 5 mm to about 10 mm, about 20 mm, and about 30 mm. When the case where the height of the top portion 31-2 is set at about 5 mm is compared to the case where the height of the top portion 31-2 is set at about 10 mm, the average gain is improved up to about 5 dB within the frequency band of the FM waveband in the case where the height is set at about 10 mm. When the case where the height of the top portion 31-2 is set at about 5 mm is compared to the case where the height of the top portion 31-2 is set at about 30 mm, the average gain is improved up to about 10 dB within the frequency band of the FM waveband in the case where the height is set at about 30 mm.

Figure 57:
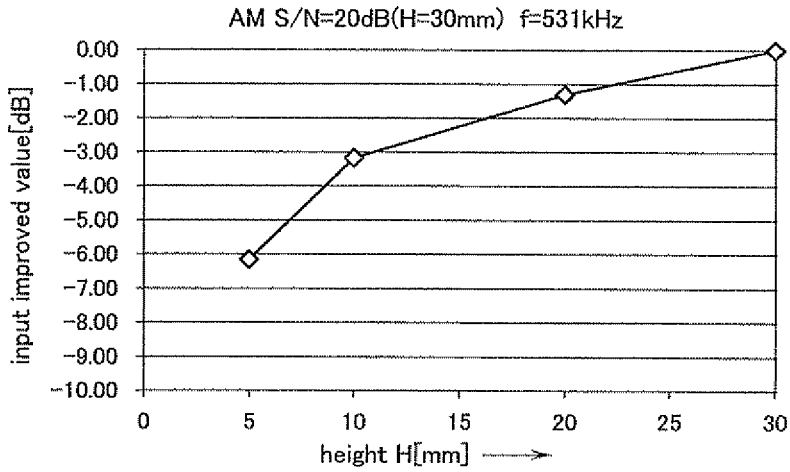
FIG. 57 is a view illustrating a change in characteristic of the S/N ratio in the AM waveband when the top portion height is gradually increased.
Figure 58:
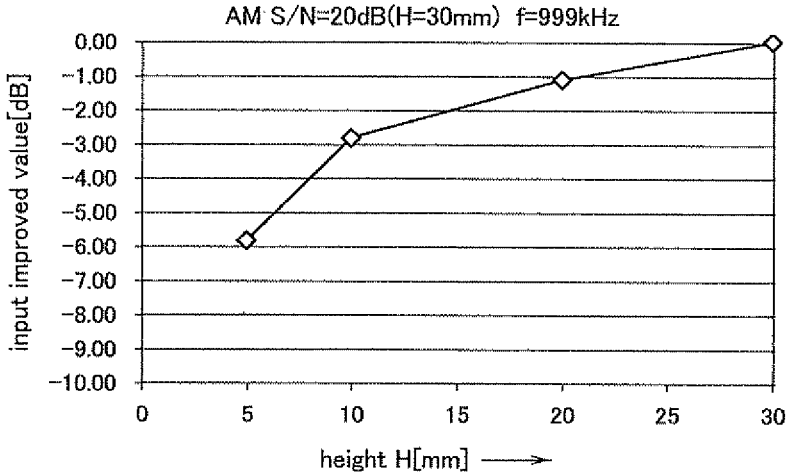
FIG. 58 is another view illustrating the change in characteristic of the S/N ratio in the AM waveband when the top portion height is gradually increased.
Figure 59:
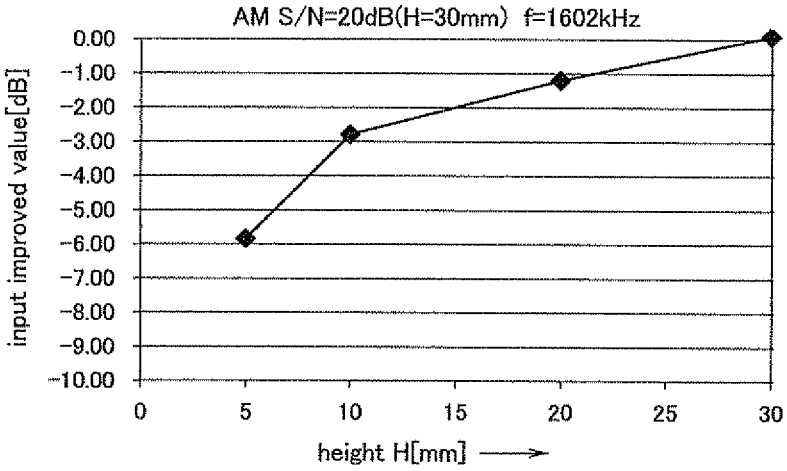
FIG. 59 is still another view illustrating the change in characteristic of the S/N ratio in the AM waveband when the top portion height is gradually increased.

FIGS. 57 to 59 illustrate a change in characteristic of the S/N ratio in the AM waveband when the height H of the top portion 31-2 is gradually increased to H1, H2, H3, and H4. In FIGS. 57 to 59, at the frequency in the AM waveband, the antenna input value in which the S/N ratio of 20 dB is obtained is standardized to 0 dB based on the height H of the top portion 31-2 from the antenna base 20 of 30 mm, and the antenna input value in which the S/N ratio of 20 dB is obtained when the height H is changed from 5 mm to about 10 mm, about 20 mm, and about 30 mm is illustrated as an input improved value [dB] with respect to the standardized antenna input value. FIG. 57 illustrates the input improved value with respect to the height H when the frequency is set at the lower limit of 531 kHz, FIG. 58 illustrates the input improved value with respect to the height H when the frequency is set at the substantially central frequency of 999 kHz, and FIG. 59 illustrates the input improved value with respect to the height H when the frequency is set at the upper limit of 1602 kHz. Referring to FIGS. 57 to 59, at the frequency of 531 kHz, although the input improved value is degraded by about 6 dB when the height H is set at 5 mm, the input improved value is increased with increasing height H, and the input improved value reaches 0 dB when the height H is set at 30 mm. At the frequency of 999 kHz, although the input improved value is degraded by about 6 dB when the height H is set at 5 mm, the input improved value is increased with increasing height H, and the input improved value reaches 0 dB when the height H is set at 30 mm. At the frequency of 1602 kHz, although the input improved value is degraded by about 6 dB when the height H is set at 5 mm, the input improved value is increased with increasing height H, and the input improved value reaches 0 dB when the height H is set at 30 mm. Thus, the S/N ratio is increased with increasing height H in the AM waveband.

Figure 60:
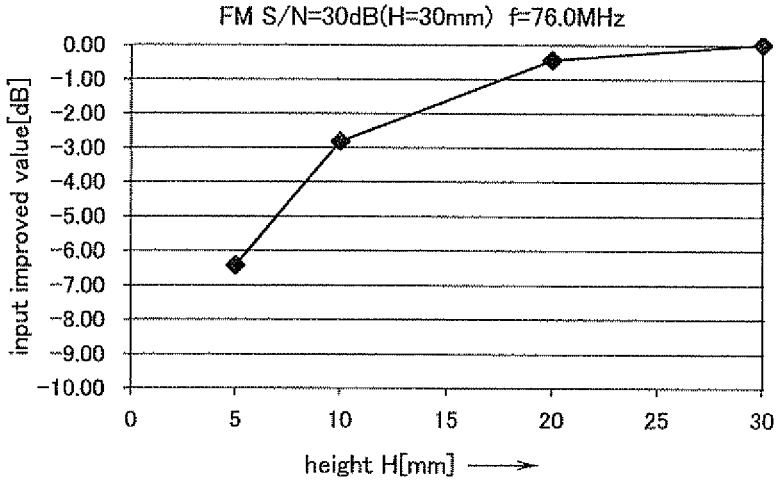
FIG. 60 is a view illustrating a change in characteristic of the S/N ratio in the FM waveband when the top portion height is gradually increased.
Figure 61:
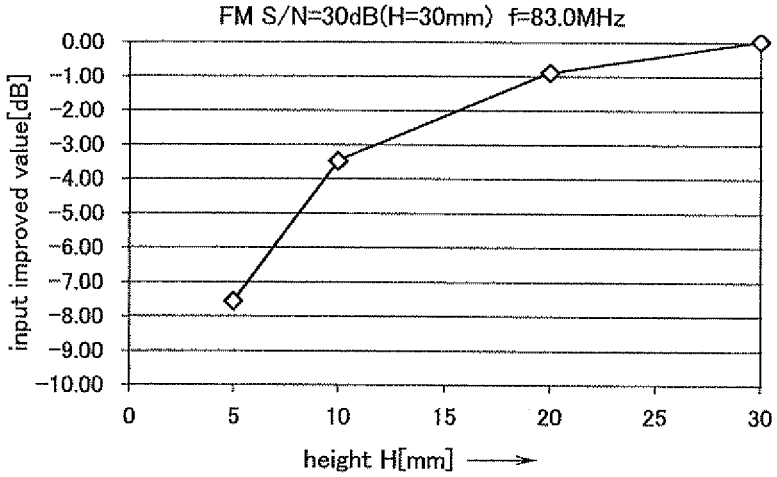
FIG. 61 is another view illustrating the change in characteristic of the S/N ratio in the FM waveband when the top portion height is gradually increased.
Figure 62:
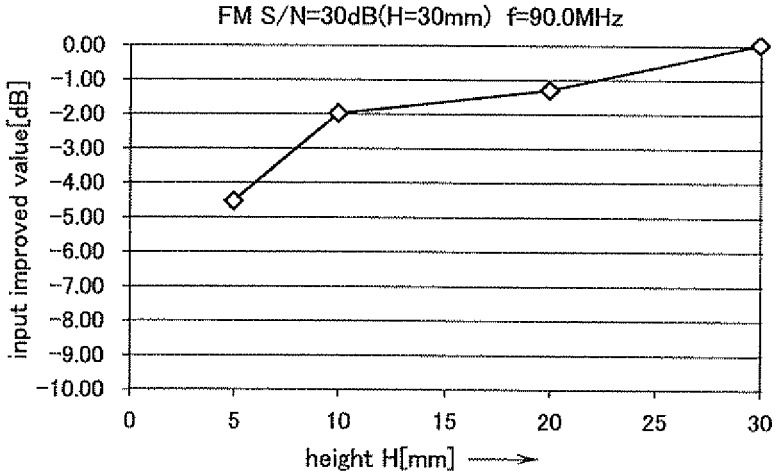
FIG. 62 is still another view illustrating the change in characteristic of the S/N ratio in the FM waveband when the top portion height is gradually increased.

FIGS. 60 to 62 illustrate frequency characteristic of the S/N ratio in the FM waveband when the height H of the top portion 31-2 is gradually increased to H1, H2, H3, and H4. In FIGS. 60 to 62, at the frequency in the FM waveband, the antenna input value in which the S/N ratio of 30 dB is obtained is standardized to 0 dB based on the height H of the top portion 31-2 from the antenna base 20 of 30 mm, and the antenna input value in which the S/N ratio of 30 dB is obtained when the height H is changed from 5 mm to about 10 mm, about 20 mm, and about 30 mm is illustrated as an input improved value with respect to the standardized antenna input value. FIG. 60 illustrates the input improved value with respect to the height H when the frequency is set at the lower limit of 76 MHz, FIG. 61 illustrates the input improved value with respect to the height H when the frequency is set at the substantially central frequency of 83 MHz, and FIG. 62 illustrates the input improved value with respect to the height H when the frequency is set at the upper limit of 90 MHz. Referring to FIGS. 60 to 62, at the frequency of 76 MHz, although the input improved value is degraded by about 6.4 dB when the height H is set at 5 mm, the input improved value is increased with increasing height H, and the input improved value reaches 0 dB when the height H is set at 30 mm. At the frequency of 83 MHz, although the input improved value is degraded by about 7.5 dB when the height H is set at 5 mm, the input improved value is increased with increasing height H, and the input improved value reaches 0 dB when the height H is set at 30 mm. At the frequency of 90 MHz, although the input improved value is degraded by about 4.5 dB when the height H is set at 5 mm, the input improved value is increased with increasing height H, and the input improved value reaches 0 dB when the height H is set at 30 mm. Thus, the S/N ratio is increased with increasing height H in the FM waveband. As can be seen from the basic experiment, as the height H of the top portion 31 from the antenna base 20 is increased, the distance from the ground that is of the antenna base 20 is increased to reduce the floating capacitance between the ground and the top portion 31. When the height is set at about 10 mm or more, the gain and the S/N ratio are improved both in the AM waveband and the FM waveband.

Figure 69:
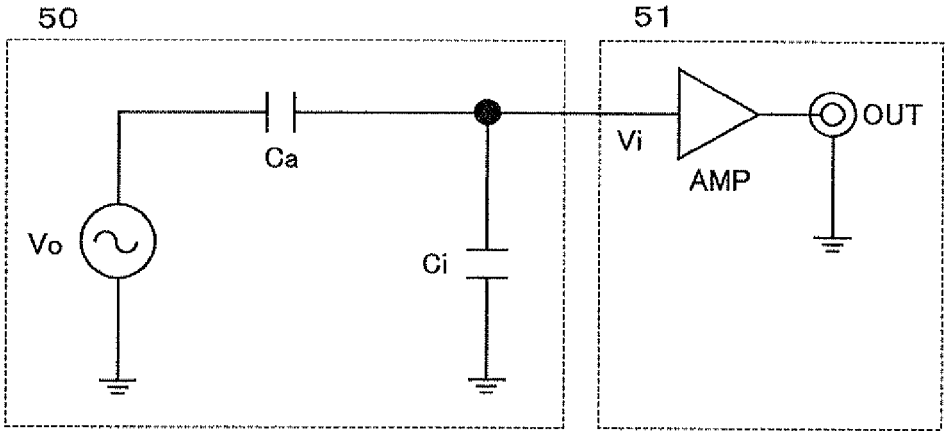
FIG. 69 is a view illustrating an equivalent circuit of the antenna apparatus according to an embodiment of the invention.

A basic experiment in which basic experimental data of the antenna capacitance is obtained in changing an area of the top portion 31 facing the antenna base 20 in the antenna apparatus 1 according to an embodiment of the invention will be described below. FIG. 69 illustrates an equivalent circuit of the antenna apparatus 1 according to an embodiment of the invention. An antenna element portion 50 of the equivalent circuit includes the top portion 31 and the antenna pattern 30*b* formed in the antenna board 30. In the antenna element portion 50, an antenna element induction voltage source VO and an antenna total capacitance Ca are connected in series. The received signal tapped off from the antenna element portion 50 is fed into an amplifier circuit portion 51 provided in the amplifier board 34. An amplifier AMP is provided in the amplifier circuit portion 51, and the fed received signal is amplified and tapped off from an output terminal OUT. An invalid capacitance Ci that is of a capacitance of an amplifier input portion is connected between the input side of the amplifier circuit portion 51 and the ground. The invalid capacitance Ci is generated by the floating capacitance of the antenna element portion 50 with respect to the ground. An antenna input voltage Vi of the received signal fed into the amplifier AMP is obtained by the following equation (1):

$$Vi = V0 \cdot Ca/(Ca+Ci) \quad (1)$$

As expressed by the equation (1), as the invalid capacitance Ci is decreased, the antenna input voltage Vi of the received signal fed into the amplifier AMP is increased to enhance the gain of the antenna apparatus 1.

Figure 63A:
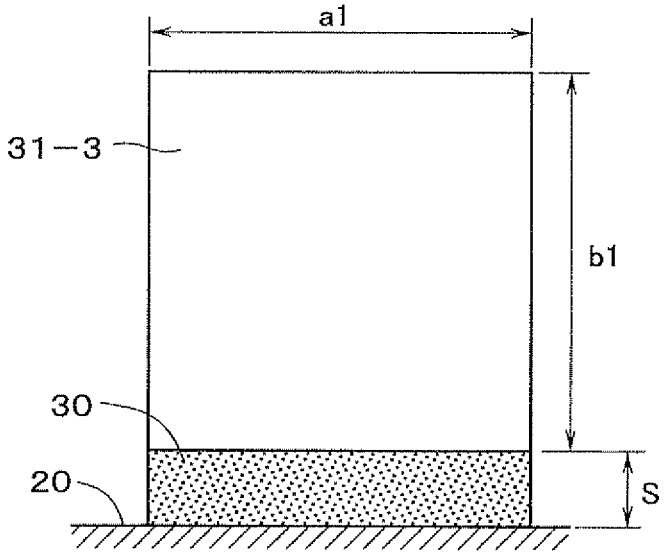
FIG. 63(*a*) is a front view illustrating a first configuration used in a basic experiment of an antenna capacitance when an area facing the antenna base of the top portion is changed and FIG. 63(*b*) is a side view illustrating a first configuration used in a basic experiment of an antenna capacitance when an area facing the antenna base of the top portion is changed.
Figure 63B:
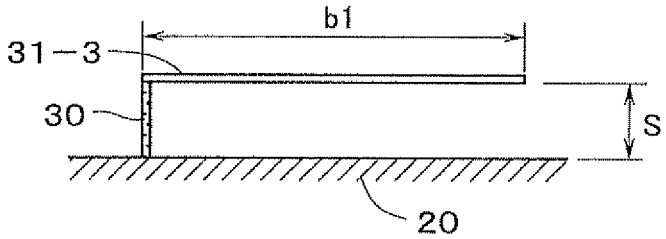
Figure 66:
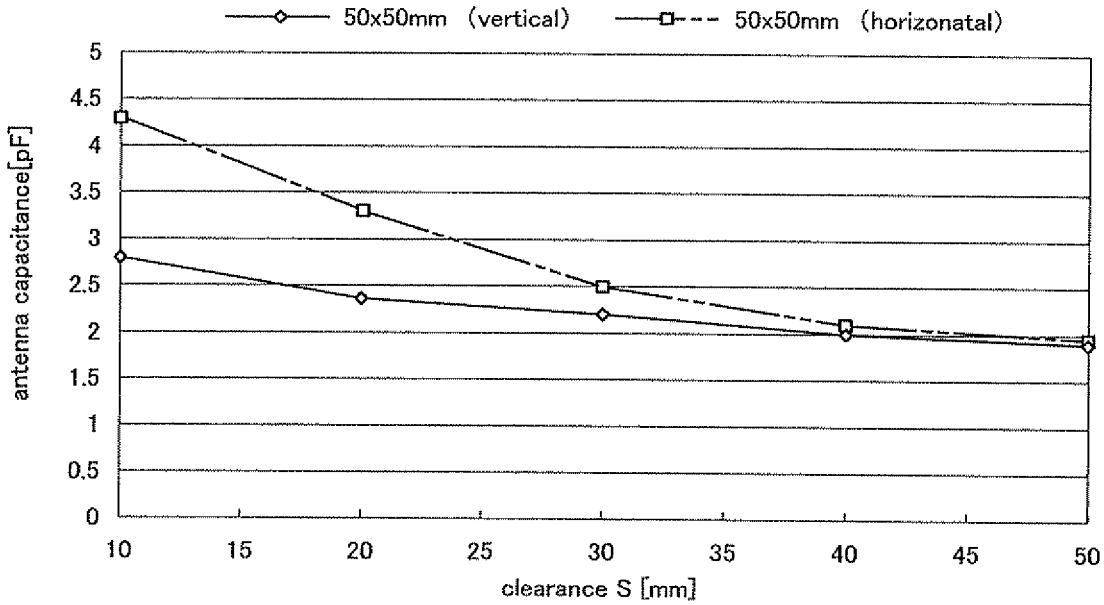
FIG. 66 is a view illustrating a change in characteristic of the antenna capacitance when a clearance is changed in the first configuration.

Therefore, in the basic experiment in which basic experimental data of the antenna capacitance (Ca+Ci) is obtained in changing the area of the top portion 31 facing the antenna base 20, three kinds of top portions 31-3 having different areas are prepared, the top portion 31-3 is disposed perpendicular to and in parallel with the antenna base 20, and the antenna capacitance is measured when the clearance S between the top portion 31 and the antenna base 20 is changed. The top portion 31-3 of FIGS. 63(*a*) and 63(*b*) has a horizontal length a1 of about 50 mm and a vertical length b1 of about 50 mm. FIG. 63(*a*) is a front view illustrating a configuration in which the top portion 31-3 is perpendicularly disposed on the antenna board 30 vertically provided on the antenna base 20, and the height of the antenna board 30 is the clearance S. FIG. 63(*b*) is a side view illustrating a configuration in which the top portion 31-3 is horizontally disposed on the antenna board 30 vertically provided on the antenna base 20, and the height of the antenna board 30 is the clearance S. In the first configuration illustrated in FIGS. 63(*a*) and 63(*b*), FIG. 66 illustrates a change in characteristic of the antenna capacitance when the clearance S is changed from about 10 mm to about 50 mm. Referring to FIG. 66, when the top portion 31-3 is perpendicularly disposed as illustrated in FIG. 63(*a*), the antenna capacitance becomes the maximum value of about 2.8 pF at the clearance S of 10 mm, the antenna capacitance is decreased with increasing clearance S, and the antenna capacitance becomes about 1.9 pF at the clearance S of 40 mm. When the top portion 31-3 is horizontally disposed as illustrated in FIG. 63(*b*), the area facing the antenna base 20 is enlarged, the antenna capacitance becomes the maximum value of about 4.3 pF at the clearance S of 10 mm, the antenna capacitance is decreased with increasing clearance S, and the antenna capacitance becomes about 2 pF at the clearance S of 40 mm.

Figure 64A:
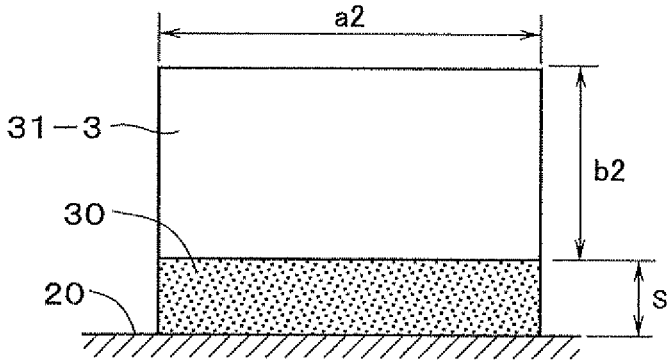
FIG. 64(*a*) is a front view illustrating a second configuration used in the basic experiment of the antenna capacitance when the area facing the antenna base of the top portion is changed and FIG. 64(*b*) is a side view illustrating a second configuration used in the basic experiment of the antenna capacitance when the area facing the antenna base of the top portion is changed.
Figure 64B:
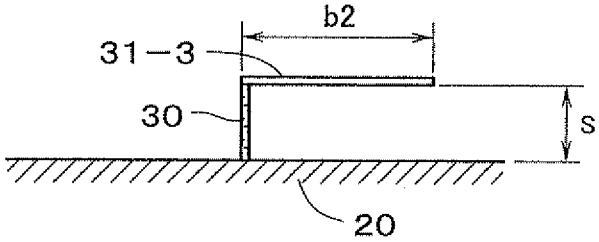
Figure 67:
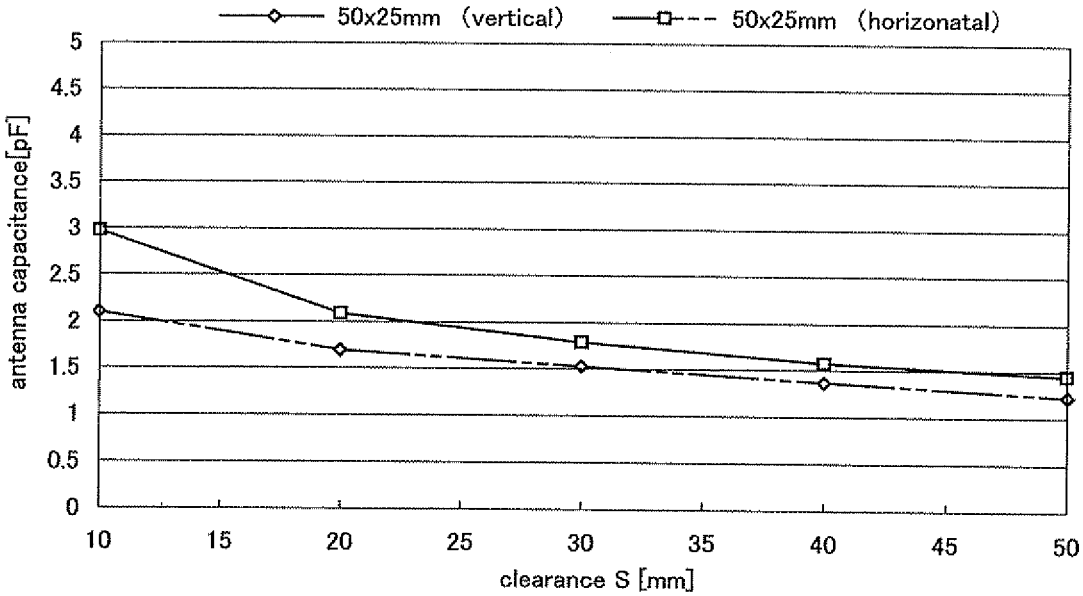
FIG. 67 is a view illustrating a change in characteristic of the antenna capacitance when the clearance is changed in the second configuration.

The top portion 31-3 of FIGS. 64(*a*) and 64(*b*) has a horizontal length a2 of about 50 mm and a vertical length b2 of about 25 mm. FIG. 64(*a*) is a front view illustrating a configuration in which the top portion 31-3 is perpendicularly disposed on the antenna board 30 vertically provided on the antenna base 20, and the height of the antenna board 30 is the clearance S. FIG. 64(*b*) is a side view illustrating a configuration in which the top portion 31-3 is horizontally disposed on the antenna board 30 vertically provided on the antenna base 20, and the height of the antenna board 30 is the clearance S. In the second configuration illustrated in FIGS. 64(*a*) and 64(*b*), FIG. 67 illustrates a change in characteristic of the antenna capacitance when the clearance S is changed from about 10 mm to about 50 mm. Referring to FIG. 67, when the top portion 31-3 is perpendicularly disposed as illustrated in FIG. 64(*a*), the antenna capacitance becomes the maximum value of about 2.1 pF at the clearance S of 10 mm, the antenna capacitance is decreased with increasing clearance S, and the antenna capacitance becomes about 1.3 pF at the clearance S of 40 mm. When the top portion 31-3 is horizontally disposed as illustrated in FIG. 64(*b*), the area facing the antenna base 20 is enlarged, the antenna capacitance becomes the maximum value of about 3 pF at the clearance S of 10 mm, the antenna capacitance is decreased with increasing clearance S, and the antenna capacitance becomes about 1.4 pF at the clearance S of 40 mm.

Figure 65A:
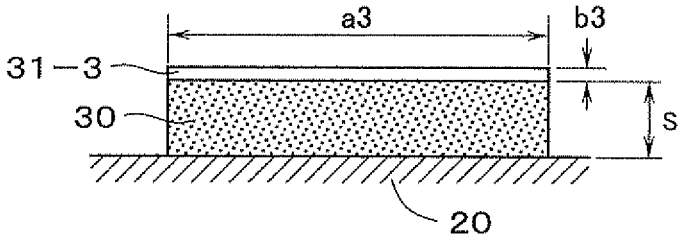
FIG. 65(*a*) is a front view illustrating a third configuration used in the basic experiment of the antenna capacitance when the area facing the antenna base of the top portion is changed and FIG. 65(*b*) is a side view illustrating a third configuration used in the basic experiment of the antenna capacitance when the area facing the antenna base of the top portion is changed.
Figure 65B:
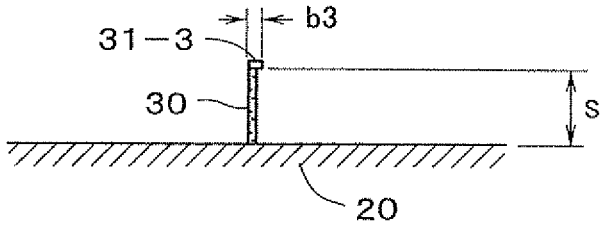
Figure 68:
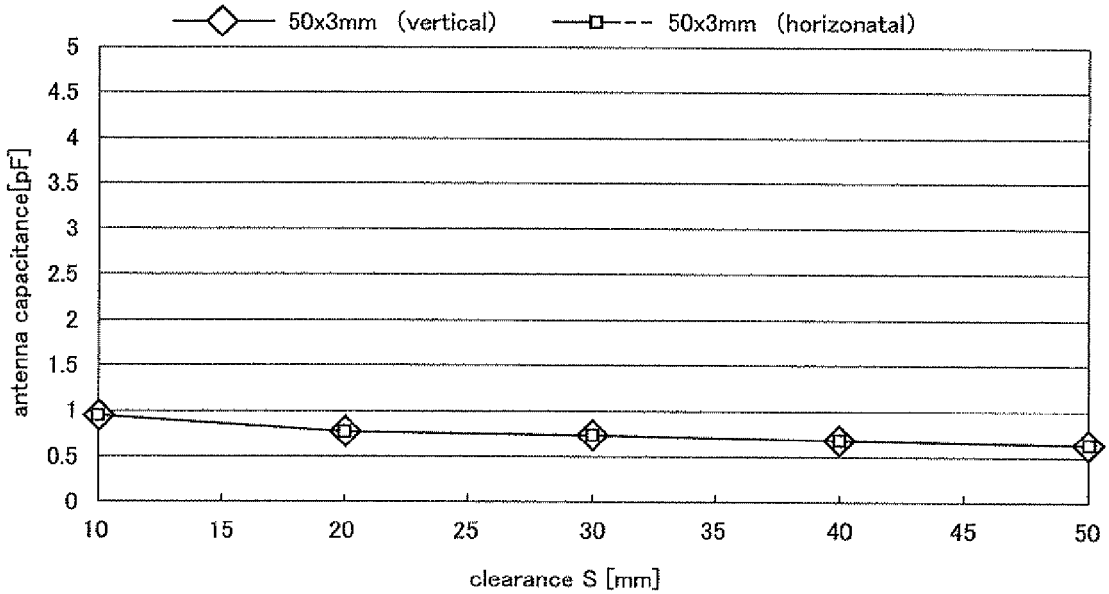
FIG. 68 is a view illustrating a change in characteristic of the antenna capacitance when the clearance is changed in the third configuration.

The top portion 31-3 of FIGS. 65(*a*) and 65(*b*) has a horizontal length a3 of about 50 mm and a vertical length b3 of about 3 mm. FIG. 65(*a*) is a front view illustrating a configuration the top portion 31-3 is perpendicularly disposed on the antenna board 30 vertically provided on the antenna base 20, and the height of the antenna board 30 is the clearance S. FIG. 65(*b*) is a side view illustrating a configuration the top portion 31-3 is horizontally disposed on the antenna board 30 vertically provided on the antenna base 20, and the height of the antenna board 30 is the clearance S. In the third configuration illustrated in FIGS. 65(*a*) and 65(*b*), FIG. 68 illustrates a change in characteristic of the antenna capacitance when the clearance S is changed from about 10 mm to about 50 mm. Referring to FIG. 68, when the top portion 31-3 is perpendicularly disposed as illustrated in FIG. 65(*a*), the antenna capacitance becomes the maximum value of about 1 pF at the clearance S of 10 mm, the antenna capacitance is decreased with increasing clearance S, and the antenna capacitance becomes about 0.7 pF at the clearance S of 40 mm. When the top portion 31-3 is horizontally disposed as illustrated in FIG. 65(*b*), the antenna capacitance becomes the maximum value of about 1 pF at the clearance S of 10 mm, the antenna capacitance is decreased with increasing clearance S, and the antenna capacitance becomes about 0.7 pF at the clearance S of 40 mm.

The antenna capacitance is the sum of the antenna total capacitance Ca and the invalid capacitance Ci, and the invalid capacitance Ci is the floating capacitance that is generated by the facing area between the antenna element portion 50 and the ground. Therefore, when the top portion 31-3 is horizontally disposed, the facing area between the top portion 31-3 and the antenna base 20 is enlarged to increase the invalid capacitance Ci. Because the invalid capacitance Ci is decreased in inverse proportion to the clearance S, the antenna capacitance is decreased with increasing clearance S. At this point, the decreased capacitance is the capacitance based on the invalid capacitance Ci, and the antenna total capacitance Ca is not changed even if the clearance S is changed. Accordingly, as can be seen from the changes in characteristics of the antenna capacities of FIGS. 66 to 68, the invalid capacitance Ci is decreased by reducing the facing area between the top portion 31-3 and the antenna base 20. Although the invalid capacitance Ci is decreased with reducing area of the top portion 31-3, the invalid capacitance Ci can be decreased by perpendicularly disposing the top portion 31-3 even if the area of the top portion 31-3 is enlarged. Therefore, the top portion 31 of the antenna apparatus 1 according to an embodiment of the invention includes the first side portion 31*a* and second side portion 31*b*, which are formed into the inclined plane steeply inclined toward both sides from the apex portion, and the area facing the antenna base 20 is reduced to decrease the invalid capacitance.

INDUSTRIAL APPLICABILITY

The low-profile antenna apparatus 1 according to an embodiment of the invention has a height of about 70 mm or less. As described above, in the antenna apparatus 1, the antenna element includes the top portion 31 and the antenna pattern 30*b* formed in antenna board 30, and the antenna element has the antenna capacitance of about 4.7 pF. At this point, the height h10 from the lower edge of the top portion 31 to the upper surface of the antenna base 20 is set at about 34.4 mm, and the top portion 31 has the above-described dimensions. Preferably the antenna apparatus 1 has the antenna capacitance of about 3 pF or more such that the antenna element acts effectively as the antenna. Preferably the height h10, expressed by the clearance S, from the lower edge of the top portion 31 to the upper surface of the antenna base 20 is set at about 10 mm or more in order to decreased the invalid capacitance. The rear portion of the top portion 31 is moved so as to be projected rearward from the rear end of the antenna base 20, which allows the improvement of the electrical characteristic. The top portion 31 is not limited to the shape of FIGS. 15 to 18, but the shape of the top portion 31-1 of FIGS. 40 to 43 may be used. In the embodiment, the top portion including the metal plate is incorporated in the antenna case by mounting the top portion in the antenna case. Alternatively, the top portion may be incorporated in the antenna case by depositing the top portion on the inner surface in the upper portion of the antenna case or by bonding the top portion to the inner surface. The antenna apparatus according to an embodiment of the invention is used in the vehicle while mounted on the roof or trunk of the vehicle. However, the invention is not limited to the in-car antenna apparatus. The invention can be applied to any antenna apparatus as long as the antenna apparatus can receive the AM waveband and the FM waveband.

The invention claimed is:

1. An antenna apparatus that is projected with a height of 70 mm or less when mounted, comprising:

an antenna case;

an antenna base fitted in a lower end of the antenna case so as to close a lower surface of the antenna case;

an antenna portion supported over the antenna base and having a conductive top portion, the conductive top portion being formed into a chevron shape having an apex portion and side portions formed as inclined planes from both sides of the apex portion, each of the side portions having at least a slit; and a coil provided adjacent to the antenna portion for compensating inductance of the antenna portion so as to resonate the antenna portion in FM wave band.

2. The antenna apparatus according to claim 1, wherein a rear portion of the conductive top portion is projected rearward from a rear end of the antenna base.

3. The antenna apparatus according to claim 1, wherein a rear edge of the conductive top portion is obliquely cut relative to a surface of the antenna base from a bottom side to top side of the conductive top portion.

4. The antenna apparatus according to claim 1, wherein the conductive top portion is fitted in the antenna case.

5. The antenna apparatus according to claim 1, which further comprises an amplifier board disposed forward from directly underneath the conductive top portion on the antenna base, the amplifier board having an amplifier thereon, the amplifier amplifying signals of an AM broadcast and an FM broadcast, the AM broadcast and the FM broadcast being received by the antenna portion.

* * * * *